US010475361B2

(12) United States Patent
Scepanovic et al.

(10) Patent No.: US 10,475,361 B2
(45) Date of Patent: Nov. 12, 2019

(54) ADJUSTABLE DISPLAY ILLUMINATION

(71) Applicant: Apple Inc., Cupertino, CA (US)

(72) Inventors: Miodrag Scepanovic, San Jose, CA (US); Angelo M. Alaimo, San Francisco, CA (US); Florian R. Fournier, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 13 days.

(21) Appl. No.: 14/612,239

(22) Filed: Feb. 2, 2015

(65) Prior Publication Data

US 2016/0225301 A1 Aug. 4, 2016

(51) Int. Cl.

| | |
|---|---|
| ***G09G 3/20*** | (2006.01) |
| ***G09G 3/32*** | (2016.01) |
| ***G09G 3/34*** | (2006.01) |
| ***G09G 3/36*** | (2006.01) |

(52) U.S. Cl.

CPC ..... *G09G 3/20* (2013.01); *G09G 3/32* (2013.01); *G09G 3/3406* (2013.01); *G09G 3/36* (2013.01); *G09G 2320/0626* (2013.01); *G09G 2330/021* (2013.01); *G09G 2360/144* (2013.01)

(58) Field of Classification Search

CPC ..... G09G 3/20; G09G 2320/064; G09G 2320/062

USPC ..... 345/589; 348/333.01, 370

See application file for complete search history.

(56) References Cited

U.S. PATENT DOCUMENTS

| | | | | |
|---|---|---|---|---|
| 7,663,691 | B2 | 2/2010 | Ciudad et al. | |
| 8,340,365 | B2 | 12/2012 | Thorn et al. | |
| 8,797,411 | B2 | 8/2014 | Corley | |
| 2003/0079224 | A1 | 4/2003 | Komar | |
| 2003/0090455 | A1* | 5/2003 | Daly | G09G 3/3426 345/102 |
| 2004/0119873 | A1* | 6/2004 | Ong | H04N 1/00127 348/362 |
| 2006/0071936 | A1 | 4/2006 | Leyvi | |
| 2007/0081094 | A1 | 4/2007 | Ciudad et al. | |

(Continued)

FOREIGN PATENT DOCUMENTS

| | | | |
|---|---|---|---|
| CN | 103312986 A * | 9/2013 | |
| WO | WO 2015/127594 A1 * | 9/2015 | H04N 5/2354 |

OTHER PUBLICATIONS

U.S. Appl. No. 15/675,451, filed Aug. 11, 2017, Christopher M. Garrido, et al.

*Primary Examiner* — King Y Poon
*Assistant Examiner* — Vincent Peren
(74) *Attorney, Agent, or Firm* — Robert C. Kowert; Meyertons, Hood, Kivlin, Kowert & Goetzel, P.C.

(57) ABSTRACT

A device which includes a display can provide adjustable light output, based in part on the color of the display screen output, to control the light output of the display screen. An illumination processor can adjustably control light output based on the colors of portions of the display screen. The light output can be adjusted to maintain the light output of the display screen across a range of colors of display screen light output. Controlling the light output of the display screen results in controlling the illuminance of a subject. The device can include a camera which captures an image of the subject and displays the image on a portion of the display screen, where the light output of a portion of the display screen can illuminate the subject such that the captured image has at least a certain level of image quality.

20 Claims, 11 Drawing Sheets

(56) References Cited

U.S. PATENT DOCUMENTS

2007/0176870 A1 8/2007 Hung
2009/0160945 A1* 6/2009 Chung ..... H04N 5/23293 348/207.1
2009/0231440 A1 9/2009 Lai et al.
2009/0268049 A1 10/2009 Kim
2009/0273661 A1* 11/2009 Mauchly ..... H04N 5/2256 348/14.08
2009/0322889 A1* 12/2009 Kujawa ..... H04N 5/2354 348/207.99
2010/0182446 A1* 7/2010 Matsubayashi .... H04N 5/23229 348/222.1
2010/0194961 A1* 8/2010 Patel ..... H04N 5/20 348/333.01
2010/0289930 A1* 11/2010 Liao ..... H04N 5/2354 348/254
2011/0109749 A1 5/2011 Chanas
2011/0115833 A1* 5/2011 Shimoyama ..... G09G 5/10 345/690
2011/0117959 A1* 5/2011 Rolston ..... A46B 7/04 455/556.1
2012/0069221 A1 3/2012 Imai
2012/0154662 A1 6/2012 Yang
2013/0027581 A1 1/2013 Price
2013/0044249 A1* 2/2013 Ledbetter ..... H04N 5/2256 348/333.01
2013/0050233 A1* 2/2013 Hirsch ..... G06F 3/038 345/589
2014/0104436 A1 4/2014 Bork
2014/0225980 A1* 8/2014 Patel ..... H04N 5/20 348/14.08
2015/0002735 A1* 1/2015 Moskovchenko ... H04N 5/2354 348/370
2015/0189138 A1* 7/2015 Xie ..... H04N 5/2256 348/222.1
2015/0243200 A1 8/2015 Pan
2016/0269652 A1 9/2016 Fukuya
2017/0124717 A1 5/2017 Baruch

* cited by examiner

ADJUSTABLE DISPLAY ILLUMINATION

BACKGROUND

Technical Field

This disclosure relates generally to digital imaging; and more specifically, to subject illumination for capturing images.

Description of the Related Art

Cameras capture images by recording the light reflected from a subject. It is necessary for the subject to be adequately illuminated so that a sufficient amount of light is reflected into the camera for recording.

A camera may use an electronic image sensor to record images. Electronic image sensors may produce an "image" even when no light falls on the sensor. This "image" represents noise produced by the sensor. There may be other forms of noise produced by the sensor as well. It can be desirable that the image produced by the subject produce signals that are substantially greater than the noise signals produced by the sensor.

Increasing the amount of light reflected onto the image sensor by increasing the amount of light illuminating the subject may improve the ratio of signal produced by the subject image to signal produced as noise, the signal to noise ratio (SNR), thus improving the quality of the captured image.

Still cameras may employ flash lighting where an extremely bright light of short duration illuminates the subject at the moment the subject image is captured. Cameras that capture a rapid succession of images to provide a moving picture, such as video cameras, may provide a light that provides a steady bright light to illuminate the subject continuously while images are being captured. These auxiliary light sources increase the amount of light falling on and reflected by the subject to improve the quality of images captured.

The amount of light falling on a subject may be termed illuminance, which is the total luminous flux incident on a surface, per unit area. It is a measure of the intensity of the incident light, wavelength-weighted by the luminosity function to correlate with human brightness perception. Similarly, luminous emittance is the luminous flux per unit area emitted from a surface. Illuminance and luminous emittance may be measured in lux. Thus, an auxiliary light source provides a level of luminous emittance to create a level of illuminance on a subject. As referred to herein, luminous emittance, illuminance, etc. is referred to interchangeably as light output. The light output of a surface, which refers to the light emitted from the surface, can have a particular color and magnitude. The color of the light output can be associated with the wavelengths of light included in the light output, and the light output magnitude can be associated with one or more of the luminance flux, radiant flux, some combination thereof, etc. of the light output.

A camera can require a minimum level of illuminance of the subject to produce an image of acceptable quality. If the subject illuminance is low, the SNR will be low and the image will appear grainy or snowy. It is desirable to provide a subject illuminance that results in a SNR that is above the level necessary to provide an image of acceptable quality. Cameras with digital image sensors are increasingly being added to various mobile devices, such as mobile telephones, personal digital assistants (PDA), mobile computers, and the like. When a camera is added to a mobile device that provides functions in addition to capturing images, the image capture may be a secondary function. As such, it is desirable to minimize the cost and space required to provide the image capture function. It would be desirable to provide subject illumination to improve the quality of captured images without adding a dedicated light source for image capture to the mobile device.

In some cases, a light source can adjustably provide light output in one or more various colors. In some cases, the light source includes one or more filters, including RGB filters, which can be adjustably controlled to adjustably "tune" a fixed-spectrum light source to emit light of one or more particular filtered wavelengths. In some embodiments, the magnitude of the filtered light output provided by the light source is different for different filtered wavelengths, such that adjusting the color of the light output results in variable illuminance of a subject. Such variability of light output magnitude and illuminance can adversely affect the use of the light source to provide the minimum level of illuminance of the subject to produce an image of acceptable quality.

SUMMARY OF EMBODIMENTS

Some embodiments provide a device which includes a display screen and an illumination processor which adjustably controls the light output of at least a portion of the display screen. Some embodiments provide a device which includes a backlight coupled to a display screen and an illumination processor which adjustably controls the light output of at least a portion of the backlight. The backlight provides an adjustable light output, which at least partially passes through the display screen as part of a light output of the display screen. The illumination processor adjustably controls the light output of at least a portion of the backlight, based at least in part upon a color of the light output of the display screen.

The backlight can include a set of light-emitting diodes (LEDs), and adjustably controlling the light output of at least a portion of the backlight can include adjustably controlling electrical current application to at least one LED of the set, based at least in part upon an adjustment of a color of the light output of at least one portion of the display screen. The illumination processor is configured to adjustably control electrical current application to at least one LED, such that the light output of at least one portion of the display screen remains within a particular range of light output across a range of colors of the light output of at least one portion of the display screen. The particular range of light output can include a particular magnitude of light output across the range of colors of the light output of at least one portion of the display screen. The illumination processor can adjustably control light output of separate LEDs differently, based on different colors of corresponding different portions of the display screen. The illumination processor can adjustably control the light output of at least a portion of the backlight based at least in part upon adjustably controlling a color of at least a portion of the backlight.

The device can include a camera oriented to capture a first image of a subject where the display screen is oriented to display the first image that is viewable by the subject and is configured to synchronously display the first image, in a first zone of the display, and adjust illumination of the subject by pixels in a second zone of the display. The illumination processor can adjustably control light output by the second zone of the display, such that the illumination processor is configured to at least partially adjustably control illumination of the subject, based at least in part upon monitoring illumination of one or more portions of the subject in the first image. To adjustably control light output by the second zone, based at least in part upon monitoring illumination of one or more portions of the subject in the first image, the illumination processor can adjustably control a shape of the second zone.

Some embodiments provide a method which includes performing, by at least one computer system, adjusting light output of a display screen, based at least in part upon a color of light output provided by at least one portion of the display screen. Some embodiments provide a method which includes performing, by at least one computer system, adjusting light output of a backlight coupled to a display screen, based at least in part upon a color of light output provided by at least one portion of the display screen. The backlight can include a set of light-emitting diodes (LEDs).

In some embodiments, adjusting light output of a display screen can include adjusting transmittance of one or more portions of a display screen. For example, where a device includes a display screen which includes a liquid crystal display (LCD) screen, the device can be configured to adjust one or more of the color, light output magnitude, etc. of one or more pixels of the LCD screen, and such adjustment can include adjusting transmittance of one or more pixels of an LCD screen based at least in part upon the colors displayed by the one or more pixels. Such adjusting can be controlled by an illumination processor, as described herein, which is coupled to the display screen.

In some embodiments, adjusting light output of a display screen can include adjusting the magnitude of emittance, also referred to herein as light output, of one or more portions of a display screen. For example, where a device includes a display screen which includes an organic light emitting diode (OLED) display, the device may be configured to provide display screen light output independently of backlights coupled to the display screen, and the device can be configured to adjust one or more of the color, light output magnitude, etc. of one or more pixels of the OLED. Such adjustment can include adjusting the magnitude of light output emitted one or more pixels of an OLED screen based at least in part upon the colors displayed by the one or more pixels. Such adjusting can be controlled by an illumination processor, as described herein, which is coupled to the display screen.

Adjusting light output of the backlight can include adjusting electrical current application to at least one LED of the set, based at least in part upon an adjustment of a color of the light output of at least one portion of the display screen. Adjusting light output of the backlight can include adjusting electrical current application to at least one LED of the set, such that the light output of at least one portion of the display screen remains within a particular range of light output across a range of colors of the light output of at least one portion of the display screen. The particular range of light output can include a particular magnitude of light output across the range of colors of the light output of at least one portion of the display screen. Adjusting light output of a backlight can include adjusting light output of separate LEDs differently, based on different colors of corresponding different portions of the display screen. The method can include adjusting a color of at least a portion of the backlight and adjusting a light output of at least a portion of the backlight based at least in part upon adjustably controlling a color of at least a portion of the backlight. The method can include adjusting light output of a backlight coupled to a display screen, based at least in part upon a color of light output provided by at least one portion of the display screen, can include adjusting a light output of the backlight based on a color of light output provided by a particular portion of the display screen which adjustably illuminates a subject of an image displayed on another separate portion of the display screen, based at least in part upon monitoring illumination of one or more portions of the subject.

Some embodiments provide a method which includes configuring a device to adjustably control light output of at least a portion of a display, based at least in part upon a color of the light output of a display screen. Such configuring can include one or more of configuring the device to control light output of at least a portion of a backlight coupled to the display screen, adjusting transmittance of one or more portions of the display screen, adjusting the magnitude of light output emitted by one or more portions of the display screen, some combination thereof, etc. A backlight can be coupled to the display screen. The configuring a device to control one or more of display screen portion transmittance, emitted light output magnitude, etc. can include coupling an instance of processor circuity to a display screen. The configuring a device to control light output of one or more portions of a backlight can include coupling an instance of processor circuitry to a power supply module configured to adjustably supply electrical power to the backlight, such that the instance of processor circuitry adjustably controls the electrical power supplied to at least a portion of the backlight, based at least in part upon a color of a light output of the display screen. The backlight can include a set of light-emitting diodes (LEDs). Adjustably controlling the electrical power supplied to at least a portion of the backlight can include adjustably controlling electrical current application to at least one LED of the set, based at least in part upon an adjustment of a color of the light output of at least one portion of the display screen. Adjustably controlling the electrical power supplied to at least a portion of the backlight can include adjustably controlling electrical current application to at least one LED of the set, such that the light output of at least one portion of the display screen remains within a particular range of light output across a range of colors of the light output of at least one portion of the display screen. The particular range of light output can include a particular magnitude of light output across the range of colors of the light output of at least one portion of the display screen. Adjustably controlling the electrical power supplied to at least a portion of the backlight can include adjusting the supply of electrical power to separate portions of the backlight differently, based on different colors of corresponding different portions of the display screen.

Figure 1A:
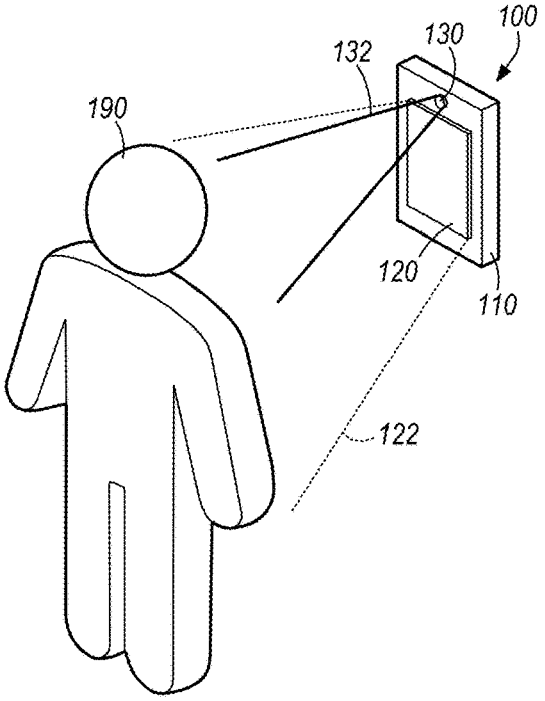
FIG. 1A-B illustrate a device which captures images of a subject and displays a captured image of the subject, according to some embodiments.

This specification includes references to "one embodiment" or "an embodiment." The appearances of the phrases "in one embodiment" or "in an embodiment" do not necessarily refer to the same embodiment. Particular features, structures, or characteristics may be combined in any suitable manner consistent with this disclosure.

"Comprising." This term is open-ended. As used in the appended claims, this term does not foreclose additional structure or steps. Consider a claim that recites: "An apparatus comprising one or more processor units . . . " Such a claim does not foreclose the apparatus from including additional components (e.g., a network interface unit, graphics circuitry, etc.).

"Configured To." Various units, circuits, or other components may be described or claimed as "configured to" perform a task or tasks. In such contexts, "configured to" is used to connote structure by indicating that the units/circuits/components include structure (e.g., circuitry) that performs those task or tasks during operation. As such, the unit/circuit/component can be said to be configured to perform the task even when the specified unit/circuit/component is not currently operational (e.g., is not on). The units/circuits/components used with the "configured to" language include hardware—for example, circuits, memory storing program instructions executable to implement the operation, etc. Reciting that a unit/circuit/component is "configured to" perform one or more tasks is expressly intended not to invoke 35 U.S.C. § 112, sixth paragraph, for that unit/circuit/component. Additionally, "configured to" can include generic structure (e.g., generic circuitry) that is manipulated by software and/or firmware (e.g., an FPGA or a general-purpose processor executing software) to operate in manner that is capable of performing the task(s) at issue. "Configure to" may also include adapting a manufacturing process (e.g., a semiconductor fabrication facility) to fabricate devices (e.g., integrated circuits) that are adapted to implement or perform one or more tasks.

"First," "Second," etc. As used herein, these terms are used as labels for nouns that they precede, and do not imply any type of ordering (e.g., spatial, temporal, logical, etc.). For example, a buffer circuit may be described herein as performing write operations for "first" and "second" values. The terms "first" and "second" do not necessarily imply that the first value must be written before the second value.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While in this case, B is a factor that affects the determination of A, such a phrase does not foreclose the determination of A from also being based on C. In other instances, A may be determined based solely on B.

DETAILED DESCRIPTION

Introduction

In some embodiments, a device which includes a display further includes a camera, oriented in a common direction as the display, which captures one or more images of at least a portion of the camera field of view. The camera thus can capture images of a subject which is observing the display. In some embodiments, the subject of the image which observes the display is a user of the device.

In some embodiments, the device displays one or more images captured by the camera on at least a portion of the display. Where the image subject is a user of the device, the display enables the user to observe a self-image captured by the camera included in the device. The user can adjust one or more properties of the device, camera, etc. including one or more of device and camera orientation, camera zoom, some combination thereof, etc. to correspondingly adjust one or more properties of the captured image. In some embodiments, where the user is a subject of the captured image, the user can manipulate at least one portion of the device to adjust the captured images of the user, while observing the captured image via the device display and observing the effects of adjusting one or more portions of the device on the captured image.

In some embodiments, the device display is configured to provide illumination of at least a portion of the camera field of view, including one or more image subjects in the field of view, which can result in improved image quality of captured images of the camera field of view. In some embodiments, the device includes a flash device which emits light concurrently with the camera capturing an image. Where the camera continuously captures and displays images, such as a video stream captured by the camera and displayed via the device display, the device display can provide illumination of the image subject without resorting to continuous use of a flash device. Where the device continuously captures and displays images, and further captures and stores a particular image based on an image capture command received at the device, the device can display a preview of the particular image on the display and a user can adjust one or more properties of the device, observe the resulting effects of the adjustments in the displayed image, and provide an image capture command which results in the device capturing and storing a captured image of the image subject.

In some embodiments, a portion of the device display provides illumination of the image subject while another portion of the device display displays captured images of the image subject. The portion of the device display which provides illumination can provide light output in one or more particular patterns, colors, magnitudes, some combination thereof, etc. The particular pattern, color, magnitude, etc. of the light output provided can be determined by one or more portions of the device. The provided light output by one or more portions of the display can result in increased SNR of captured images of the subject. The adjustable color, pattern, and magnitudes of the provided light output of the display can enable increased image quality under a variety of ambient lighting conditions.

In some embodiments, the display includes a display screen, which can include various display screen portions, and a backlight component, also referred to herein as a "backlight" coupled to a side of the display screen which is distal from the device exterior, where the backlight includes one or more backlight elements which emit light, referred to herein as backlight light output, which passes through the display screen and travels away from the device, referred to herein as display screen light output. In some embodiments, the display screen portions can adjust the color of the display screen light output based at least in part upon selectively filtering various wavelengths of the backlight light output which passes through the respective display screen portions, such that the filtered light output has selected wavelengths which result in the filtered illumination having one or more particular colors. In some embodiments, the display screen portions can adjust one or more of the color and magnitude of the light output of the display screen portions based at least in part upon adjusting the transmittance of the display screen portions. In some embodiments, the display screen portions can adjust one or more of the color and magnitude of the light output of the displays screen portions based at least in part upon adjusting the magnitude of light output emitted by the display screen portions.

In some embodiments, the backlight light output provided by a backlight element, where the backlight element can include a light-emitting diode (LED), has a fixed wavelength spectrum. The magnitude of the backlight light output can be different at different wavelengths along the spectrum of the backlight light output. For example, where the full spectrum of the backlight light output by a backlight element has a magnitude of one lumen, the backlight light output can have a magnitude of 0.8 lumens when certain wavelengths are filtered output of the backlight light output. As a result, filtering the backlight light output, where the backlight light output is provided at a fixed magnitude, can result in display screen light output which has different magnitudes based on the wavelengths which are filtered out of the backlight light output by the display screen portions.

In some embodiments, the variation in display screen light output magnitude, which can result from filtering the backlight light output to achieve various display screen light output colors, can be at least partially mitigated through adjusting the transmittance of one or more display screen portions, adjusting the magnitude of light output emitted by one or more display screen portions, adjusting the backlight light output magnitude, provided by one or more particular backlight elements, some combination thereof, etc., based at least in part upon the color displayed by one or more display screen portions. A display screen portion can display a color based at least in part upon filtering one or more wavelengths out of backlight light output passing through the respective display screen portion, filtering one or more wavelengths out of light emitted by the display screen portion, some combination thereof, etc. The adjusting can include adjusting the supply of electrical power to the one or more backlight elements, display screen portions, etc. to cause the backlight elements, display screen portions, etc. to cause the adjustment to the backlight light output magnitude provided by the respective backlight elements, the adjustment to the magnitude of light output emitted by the respective display screen portions, etc. In some embodiments, the adjusting is based at least in part upon a particular target display screen light output magnitude, so that the backlight light output magnitude, display screen portion transmittance, display screen portion emitted light output magnitude, etc. is adjusted, based at least in part upon the display screen portion color, to result in a display screen light output which at least meets the target magnitude. The target display screen light output magnitude can be fixed across a range of display screen light output colors. As a result, a target illumination of an image subject can be uniformly maintained regardless of the color of the light output provided by the display screen. The device can dynamically adjust backlight light output magnitude, display screen portion transmittance, display screen portion emitted light output magnitude, etc. differently and independently for separate backlight elements, display screen portions, etc., based at least in part upon separate display colors of separate display screen portions.

In some embodiments, the backlight light output magnitude, display screen portion transmittance, display screen portion emitted light output magnitude, etc. is adjusted based at least in part upon a predetermined relationship between display screen light output magnitude, display screen color, and one or more of backlight light output magnitude, backlight element electrical power consumption, display screen portion transmittance, display screen portion light emitted light output magnitude, display screen portion power consumption, some combination thereof, etc. The relationship can be developed based at least in part upon tracking and processing variations in display screen light output magnitude and color, along with one or more of backlight light output magnitude, backlight electrical power consumption, display screen portion transmittance, display screen portion emitted light output magnitude, display screen portion power consumption, some combination thereof, etc.

Device Including Adjustable Display Screen Light Output

Figure 1B:
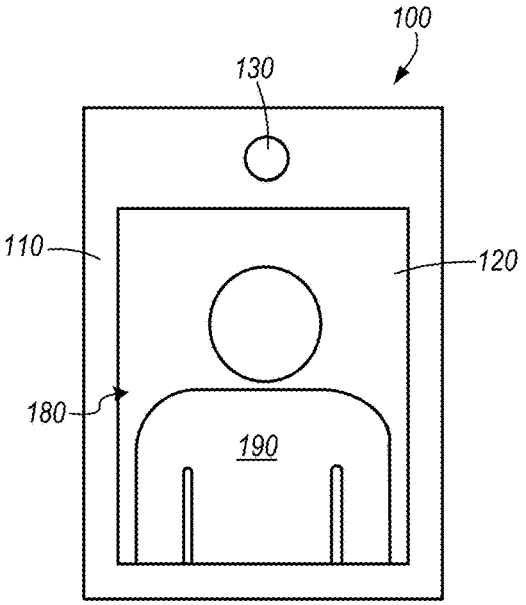

FIG. 1A-B illustrate a device which captures images of a subject and displays a captured image of the subject, according to some embodiments.

In some embodiments, the device 100 is configured to capture images of a subject and display a captured image of the subject, to the subject, via a display screen. The device 100 includes a housing 110 which includes a camera device 130, also referred to herein interchangeably as a "camera", which captures an image of one or more objects located within the camera field of view 132, including the image subject 190. The device 100 housing 110 includes a display 120, which can include a display screen, which is oriented to display an image 180 of the subject 190 in a direction of the subject 190. The image 180 can include one or more images of the subject 190 which are captured by camera 130. The display 120 can include one or more display screens which can include a liquid crystal display (LCD), organic light emitting diode (OLED) display, LED display, some combination thereof, etc. In some embodiments, the display screen includes one or more display screen portions, which can include one or more sets of display pixels.

In some embodiments, the device 100 display 120 emits light 122, referred to herein interchangeably as display screen light output, that passes from display 120 toward the subject 190. The device 100 can adjust a magnitude of the light output 122 responsive to a quality of the captured image 180 of the subject 190. Thus, the display 120 is used both to display an image 180 to the subject 190 and to illuminate the subject 190 via a provided light output 122 of the display 120. As referred to herein, the display light output and the display screen light output can be referred to interchangeably. In some embodiments, the displayed image 180 is manipulated to increase the illumination of the subject 180 above a particular level associated with an acceptable image.

In some embodiments, the device 100 includes a mobile telephone configured to capture audio in a speakerphone arrangement. The camera 130 and the display 106 may be used to transmit images of the parties to the telephone conversation to provide video conferencing. The display may include an image 180 of the called party and may further include an image of the calling party 190.

In some embodiments, the light output 122 provided by the display 120 is provided by one or more particular portions of the display screen included in the display 120, where the one or more particular portions of the display screen are selected to provide a particular pattern of light output. In some embodiments, the light output 122 can be adjusted in one or more of magnitude and color, provided by one or more particular portions of the display 120 screen.

Figure 2:
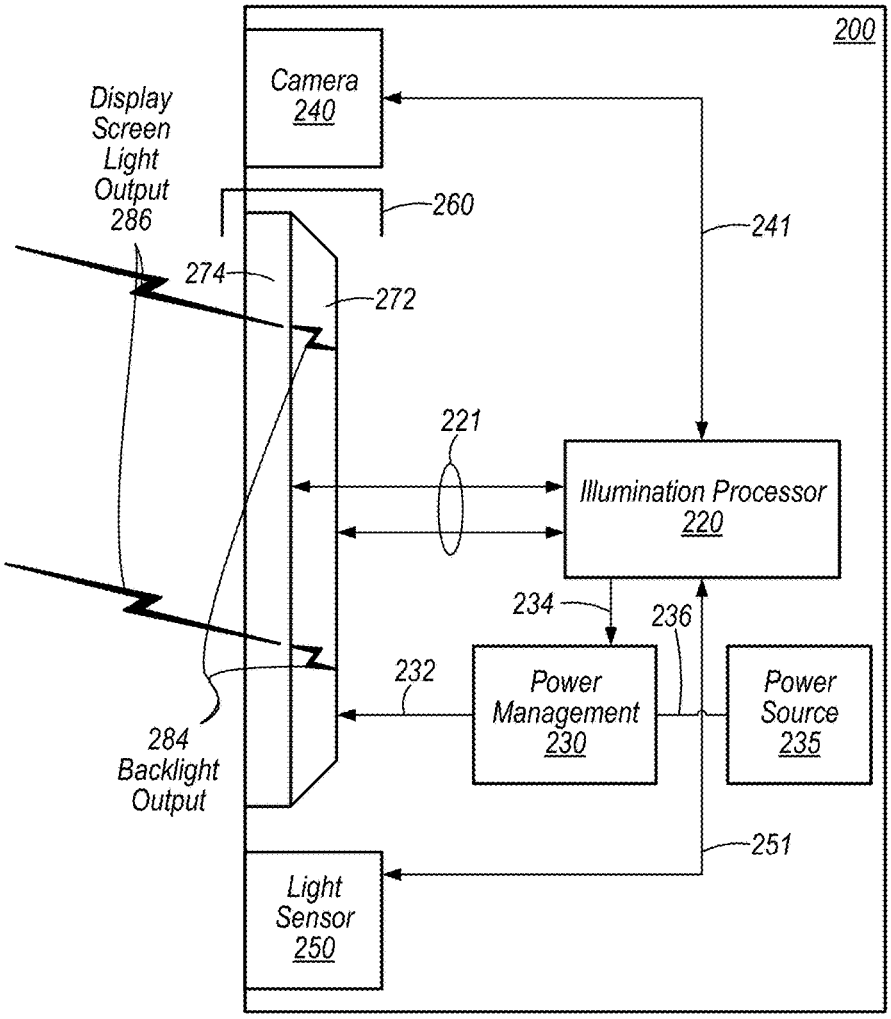
FIG. 2 illustrates a device which captures images and displays images via a display screen, according to some embodiments.

FIG. 2 illustrates a device which captures images and displays images via a display screen, according to some embodiments. The device 200 can be included in any of the embodiments included herein.

The device 200 includes a camera 240 which captures one or more images of a camera field of view, which can include one or more images of one or more image subjects located within the camera field of view.

The device 200 includes a display 260 which further includes a display screen 274 and a backlight component 272, also referred to herein interchangeably as a "backlight", coupled to the display screen 274. The backlight 272 provides light 284, also referred to herein as backlight light output, backlight illumination, etc., that passes through the display screen 274 and away from device 200 as "display screen light output" 286, which can be referred to herein as display screen light output. In some embodiments, one or more portions of the display screen 274 emit light which comprises the display screen light output 286. For example, in some embodiments the backlight 272 can be absent from device 200 and the display screen light output 286 comprises light emitted by one or more portions of the display screen 274. In some embodiments, the display screen light output 286 illuminates a subject of one or more images captured by camera 240.

The device 200 includes an illumination processor 220 which is coupled to the camera 240 and the display 260. In some embodiments, processor 220 is implemented by one or more instances of processing circuitry. In some embodiments, processor 220 is implemented by one or more computer systems. As shown, processor 220 can be coupled to the camera 240 via a communication link 241, and processor 220 can receive image data, associated with an image captured by camera 240, via link 241. As further shown, processor 220, to be coupled to the display 260, can be coupled to one or more of the backlight 272, display screen 274, some combination thereof, etc. via one or more links 221.

In some embodiments, processor 220 adjustably controls the light output 286 provided by the display 260 as display screen light output. Such adjustable control can include adjustably controlling the color of one or more portions of the display screen 274, adjustably controlling the magnitude of backlight light output provided by one or more corresponding portions of the backlight 272, adjustably controlling the magnitude of light output emitted by one or more portions of the display screen, adjustably controlling the transmittance of one or more portions of the display screen, some combination thereof, etc. The adjustably controlling can be based at least in part upon a quality of an image captured by the camera 240. In some embodiments, adjusting the backlight light output provided by one or more particular backlight portions, referred to herein as "backlight elements", results in adjusting the display screen light output 286 provided by the display 260. In some embodiments, adjusting the display screen light output 286 results in adjusting the illuminance of a subject captured in one or more images by camera 240. As a result, in some embodiments, one or more of the display screen 274, the backlight 272, etc. is adjustably controlled, by the processor 220, to controllably illuminate an image subject to improve the quality of one or more captured images, captured by camera 240, of at least the image subject.

Device 200 includes a power management module 230. In some embodiments, module 230 includes one or more instances of hardware configured to adjustably control the supply of electrical power, by one or more power sources 235 included in the device 200, to one or more backlight elements included in backlight 272, one or more portions of display screen 274, etc. As shown, the module 230 is coupled to the processor 220 via a link 234 and is coupled to the backlight 272 via another link 232. Link 232 can include an electrical circuit via which electrical power is supplied to one or more backlight 272 elements to cause the one or more backlight 272 elements to emit light, thereby providing backlight light output. Link 232 can include an electrical circuit via which electrical power is supplied to one or more display screen 274 portions to cause the one or more display screen 274 portions to emit light, thereby providing display screen light output independently of a backlight. In some embodiments, module 230 receives electrical power from power source 235 via electrical circuit 236 and supplies at least some of the received electrical power to one or more backlight 272 elements, display screen 274 portions, etc. via one or more electrical circuit links 232. Link 234 can include one or more of an electrical circuit via which at least command signals are transmitted between the processor 220 and module 230 as one or more electrical signals, one or more communication connections via which at least command signals are transmitted between the processor 220 and module as one or more data signals, etc. In some embodiments, to adjustably control the backlight light output provided by one or more backlight elements, the processor 220 adjusts the amount of electric power provided to the one or more backlight elements by the power management module 230.

Device 200 includes an ambient light sensor 250 which is coupled to the processor 220 via a link 251. In some embodiments, processor 220 adjusts the display screen light output 286, based at least in part upon adjusting one or more of the backlight light output 284, display screen emitted light output magnitude, display screen transmittance, some combination thereof, etc. based at least in part upon an ambient light level and an ambient light color sensed by the ambient light sensor 250.

In some embodiments, the illumination processor 220 increases the illumination 284, thereby increasing the illumination 286, based at least in part upon determining a low signal to noise ratio (SNR) in one or more portions of an image captured by camera 240.

In some embodiments, the illumination processor 220 adjusts an image displayed on the display 260. Such adjustment can include adjustably controlling one or more of the colors, light output magnitude, etc. of one or more portions of the display screen 274 on which one or more portions of the image are displayed, adjustably controlling the magnitude of backlight light output 284 provided by one or more backlight 272 elements which correspond to the one or more display screen 274 portions, some combination thereof, etc. such that the illumination of the image subject by light output 286 provided by the displayed image of the subject is adjustably controlled.

Figure 3:
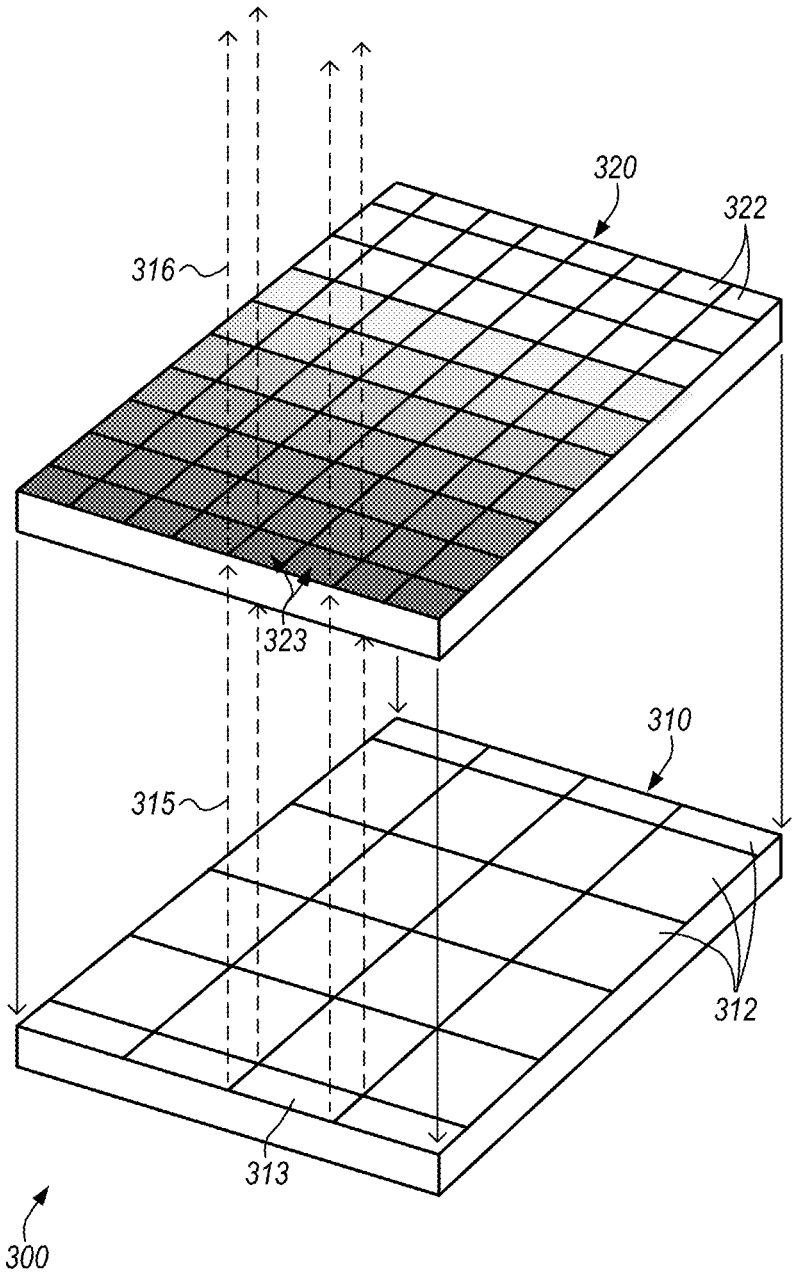
FIG. 3 illustrates a display, according to some embodiments.

FIG. 3 illustrates a display, according to some embodiments. The display 300 can be included in any of the embodiments included herein.

Display 300 includes a display screen 320 and a backlight 310. The backlight 310, in some embodiments, is coupled to at least one surface of the display screen 320.

In some embodiments, display screen 320 includes a liquid crystal display. Display screen 320 includes a set of display screen portions 322. Each portion 322, in some embodiments, includes one or more separate display screen pixels. In some embodiments, each separate portion 322 can be independently adjustably controlled to display separate colors. In some embodiments, each separate portion can be independently adjustably controlled to provide various levels of transmittance, light emittance, etc.

Backlight 310 includes a set of backlight elements 312. In some embodiments, one or more backlight elements 312 include one or more separate light sources. The one or more separate light sources can include one or more light-emitting diodes (LEDs). In some embodiments, each separate backlight element 312 can be independently adjustably controlled to provide separate magnitudes of backlight light output.

In some embodiments, one or more particular backlight elements 312 corresponds to one or more particular display screen portions, based at least in part upon the backlight light output by the particular backlight elements 312 passing through the particular display screen portions as display screen light output. Such particular backlight elements can be referred to as corresponding backlight elements, relative to the particular display screen portions, and the particular display screen portions can be referred to as corresponding display screen portions, relative to the particular backlight elements. For example, in the illustrated embodiment, backlight element 313 emits backlight light output 315 which passes through display screen portions 323 as display screen light output 316 provided by portions 323; as a result, backlight element 313 is a corresponding backlight element, relative to portions 323, and portions 323 are corresponding display screen portions, relative to backlight element 313.

In some embodiments, backlight light output which passes through one or more display screen portions 322 is at least partially filtered, such that the display screen light output includes at least partially filtered backlight light output. Separate display screen portions can be adjustably controlled independently to independently control the filtering of one or more wavelengths of backlight light output at the separate display screen portions, such that the display screen light output provided by the separate portions 312 can include separate sets of wavelengths of light, which can thereby result in display screen light output provided by different portions 312 having different visible colors. Thus, as shown in FIG. 3, separate display screen portions 322 can be adjustably controlled to filter backlight light output differently 314 to adjustably control the color displayed by one or more different sets of portions 322 of the display screen 310.

In some embodiments, display screen light output 316 is adjusted based on adjusting the transmittance of various display screen portions 322. In some embodiments, backlight 310 is absent, including where the display 300 comprises an OLED, and the output 316 is provided via light emitted by one or more of the portions 322. In some embodiments, the output 316 magnitude can be adjusted based at least in part upon adjusting the magnitude of light output emitted by one or more portions 322.

Figure 4A:
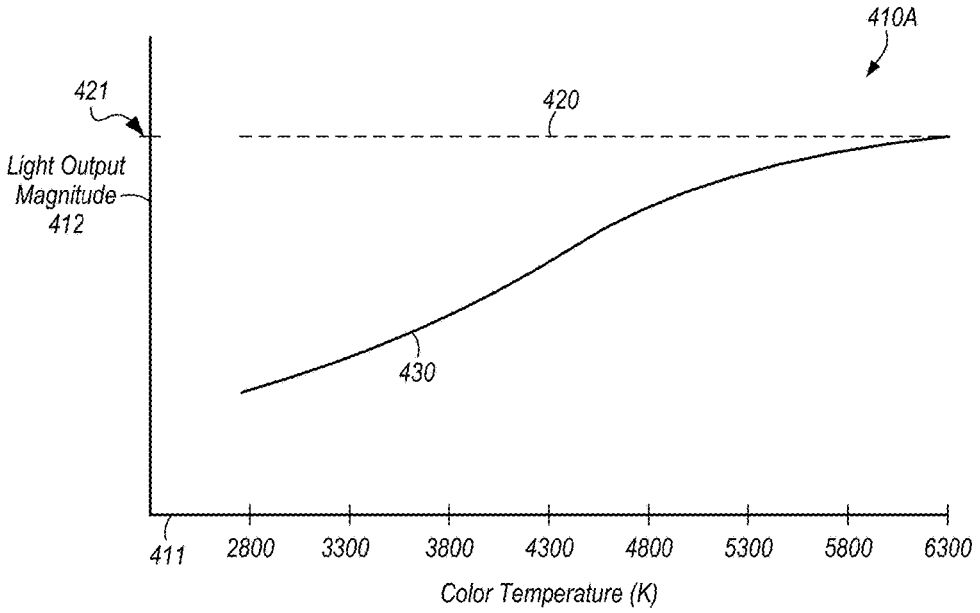
FIG. 4A-B illustrate variation of light output of a display screen based at least in part upon variation in color of the light output, according to some embodiments.
Figure 4B:
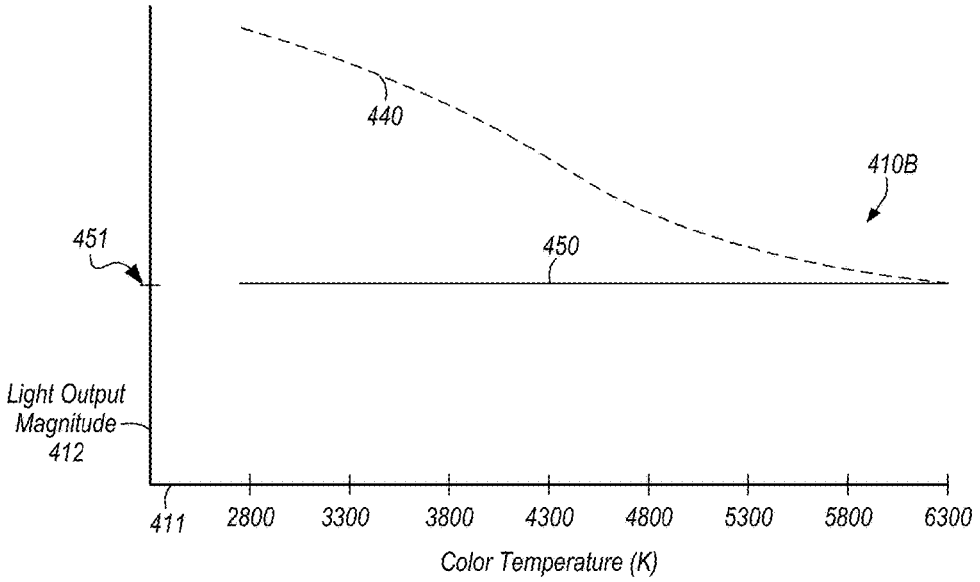

FIG. 4A-B illustrate variation of display screen light output, provided by one or more portions of a display screen, based at least in part upon variation in color of the display screen light output, according to some embodiments. The illustrated variation can be implemented by one or more display screens, one or more coupled backlights, etc. included in any of the embodiments included herein.

FIG. 4A illustrates a graphical representation 410A of the variation of the magnitude 412 of display screen light output 430, provided by a display screen portion, over a range of colors 411 displayed by the display screen portion, where the colors are represented in the representation 410A as color temperatures 411, and where the backlight light output 420 provided by a corresponding one or more backlight elements relative to the display screen portion has a fixed magnitude 421 across the range of color temperatures 411 of the display screen light output 430.

In some embodiments, the display screen light output magnitude varies based at least in part upon the color of the display screen light output. The display screen portion providing the display screen light output, in some embodiments, adjustably controls the color of illumination 430 based at least in part upon selectively filtering one or more wavelengths of the backlight light output 420 passing through the display screen portion, such that the display screen light output 430 includes at least partially filtered backlight light output 420.

In some embodiments, the backlight light output includes light emitted by a backlight element at various wavelengths, where at least some different wavelengths of light included in the backlight light output have different magnitudes. For example, where a backlight element includes an LED, the LED, in some embodiments, emits a single, fixed spectrum of light where the light emitted by the LED has different illumination magnitudes at different wavelengths. Where one or more filters, which can include one or more RGB filters, are used to at least partially filter the backlight light output to result in a display screen light output having one or more particular colors, the display screen light output, for a given fixed magnitude of the backlight light output, can have different magnitudes based on the color of the display screen light output.

In the illustrated embodiments shown in FIG. 4A, while the backlight light output 420 provided by a backlight element is fixed, the display screen light output 430 provided by a corresponding display screen portion varies over a range of colors of the light output 430, as the light output color is adjusted based on adjustably filtering one or more wavelengths of the backlight light output 420. In addition, the backlight light output has reduced magnitude at wavelengths corresponding to lower color temperatures relative to light output magnitude at wavelengths corresponding to higher color temperatures. As a result, as shown, where the display screen portion is adjustably controlled to adjustably filter the backlight light output 420 to provide display screen light output 430 at various colors, the display screen light output magnitude is less at wavelengths corresponding to lower color temperatures relative to the light output magnitude at wavelengths corresponding to higher color temperatures.

FIG. 4B illustrates a graphical representation 410B of the display screen light output of a device, over a range of colors 411 displayed by the display screen portion, where the colors are represented in the representation 410B as color temperatures 411, and where the magnitude 412 of backlight light output 440, provided by a backlight element, varies over the range of colors 411, and the display screen light output 450 is fixed in magnitude over the range of colors 411.

In some embodiments, the backlight light output magnitude, of backlight light output provided by one or more backlight elements, can be adjusted based on the color displayed by the corresponding one or more display screen portions, such that the display screen light output, provided by the corresponding display screen portion based on the backlight light output passing through and being filtered by the display screen portion, has a particular magnitude 451 across the range of display screen light output colors.

The particular magnitude 451 can be a predetermined fixed magnitude. In some embodiments, the particular magnitude is a magnitude which is determined as a target illumination magnitude which provides a particular target amount of illumination of one or more image subjects.

In some embodiments, the backlight light output provided by one or more backlight elements can be adjusted in magnitude, based on the color displayed by of one or more corresponding display screen portions, such that the display screen light output has at least a particular magnitude. Because the display screen portion, to display a particular color, can utilize at least some filtering systems to at least partially filter at least some wavelengths of light from the backlight light output passing through the display screen portion, and because different wavelengths of the backlight light output can have different magnitudes, adjusting the backlight light output magnitude based on the color displayed by the displays screen portion can result in maintaining a particular display screen light output magnitude while accounting for variable magnitudes of the backlight light output at various wavelengths. As a result, the backlight can be adjusted to compensate for a change in magnitude of the backlight light output at certain wavelengths.

As shown in FIG. 4B, the backlight light output 440 is adjusted in magnitude across the range of color temperatures 411 of the display screen, so that the backlight light output magnitude increases with decreasing color temperatures provided by a corresponding display screen portion. The variation of backlight light output magnitude over the range in color temperatures compensates for a corresponding drop in magnitude of the backlight light output at wavelengths corresponding to the lower color temperatures. As a result, although the backlight light output 440 magnitude increases with decreasing color temperatures 411, the display screen light output 450 has a fixed particular magnitude 451.

In some embodiments, where display screen portions emit light independently of backlight elements, the display screen portions can emit light in a fixed spectrum which is selectively filtered, transmitted, etc. The emitted light, also referred to herein as emitted light output of one or more display screen portions can be adjusted across the range of color temperatures of the display screen, so that the display screen light output magnitude remains fixed over the range. For example, where display portions emit light independently of a backlight, FIG. 4B can show the emitted light output magnitude 440 of the display screen portions increasing with decreasing color temperatures 411 provided by the display screen portions, where the variation in display screen portion emitted light output magnitude 440 compensates for a corresponding drop in color temperature, so that the display screen portion light output 450 is fixed over the range of color temperatures.

In some embodiments, the display screen portions can selectively transmit light provided from a backlight. The transmittance of one or more display screen portions can be adjusted across the range of color temperatures of the display screen, so that the display screen light output magnitude remains fixed over the range. For example, FIG. 4B can show the transmittance 440 of the display screen portions increasing with decreasing color temperatures 411 provided by the display screen portions, where the variation in display screen portion transmittance 440 compensates for a corresponding drop in color temperature, so that the display screen portion light output 450 is fixed over the range of color temperatures. Such transmittance adjustment can be implemented where a coupled backlight provides backlight light output at a fixed magnitude, as shown by 420 in FIG. 4A, so that the display screen portion transmittance can be adjusted to compensate for reduced backlight light output magnitudes at lower color temperatures.

In some embodiments, the relationship between one or more of backlight light output magnitude, display screen portion transmittance, display screen portion emitted light output magnitude, some combination thereof, etc. and one or more of display screen light output color, color temperature, some combination thereof, etc., is predetermined based at least in part upon a calibration process whereby the display screen light output color and magnitude, provided by one or more display screen portions, is detected by one or more light sensor devices and tracked as the display screen light output color and magnitude varies over time. In some embodiments, the calibration process can include monitoring one or more of the backlight light output magnitude, backlight electrical power consumption, display screen portion power consumption, display screen portion transmittance, display screen portion emitted light output magnitude, some combination thereof, etc. One or more instances of processing circuitry, which can include the illumination processor described herein, can process the sensor data generated by the light sensor to generate a relationship between display screen light output magnitude, display screen light output color, and one or more of backlight light output magnitude, display screen portion transmittance, display screen portion emitted light output magnitude, etc. In some embodiments, the relationship includes a relationship between display screen light output magnitude, display screen light output color, and one or more of backlight electrical power consumption by one or more backlight elements, display screen portion electrical power consumption by one or more display screen portions, etc. The relationship can be stored in one or more instances of memory included in one or more portions of the device in which the backlight and display screen are included, including one or more computer systems which implement at least the illumination processor.

In some embodiments, the illumination processor can adjust one or more of the backlight light output magnitude provided by one or more particular backlight elements, the display screen portion transmittance of one or more display screen portions, the magnitude of display screen light output emitted by one or more display screen portions, etc. to a particular target magnitude, based at least in part upon the color displayed by the corresponding display screen portion, a determined target display screen light output magnitude, and the relationship. Such adjustment can include adjusting the electrical power consumption by one or more backlight elements, display screen portions, etc. to a target electrical power consumption, also referred to herein as a target supply of electrical power, which is determined, based at least in part upon a stored relationship, to correspond to a target display screen light output magnitude based on the display screen light output color.

Figure 5A:
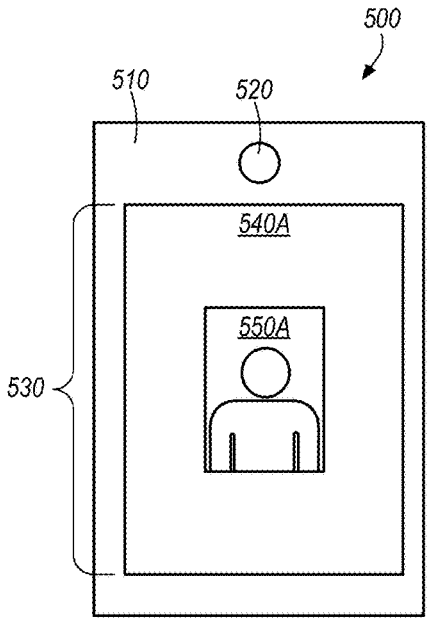
FIG. 5A-C illustrate devices including display screens which display images in one or more limited portions of the display screen and provide illumination in one or more other limited portions of the display screen, according to some embodiments.
Figure 5B:
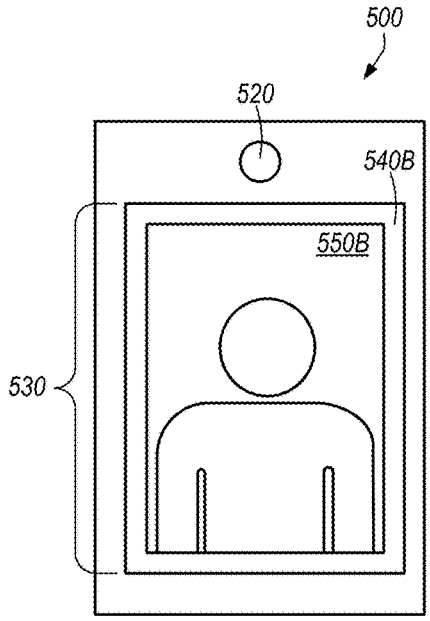
Figure 5C:
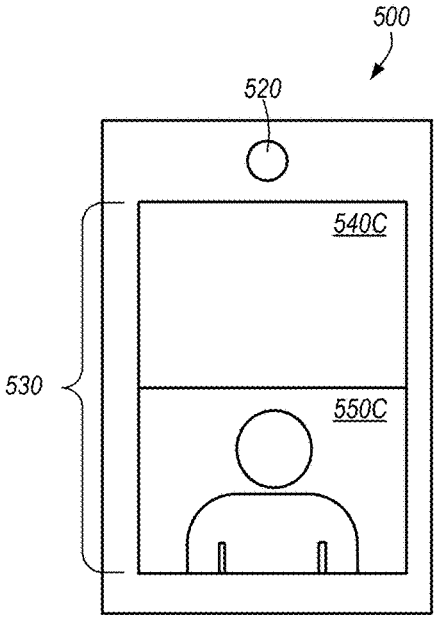

FIG. 5A-C illustrate devices including display screens which display images in one or more limited portions of the display screen and provide illumination in one or more other limited portions of the display screen, according to some embodiments.

In some embodiments, the display of a device can be adjustably controlled to provide adjustable illumination of a subject included in an image displayed by the device display. The adjustable illumination of the subject can result in enhancing the signal to noise ratio (SNR) of the displayed image. In some embodiments, the illumination can be provided via light output provided by particular portions of the display, and the light output provided by the various display portions can be different, such that light output is provided in one or more particular patterns which provide a corresponding pattern of illumination of at least the image subject. The illumination pattern can be determined by an illumination processor as a pattern of illumination, of the image subject, which optimizes image subject illuminance. The illumination pattern can include a pattern where different portions of the display provide illumination, as display screen light output, with different magnitudes and colors.

FIG. 5A-C illustrate different light output patterns provided by a display 530 of a device 500, where the display 530 and a camera 520 are included in the device housing 510 and an image captured by the camera 520 is displayed on a first portion 550A-C of the display 530, while illumination of an image subject located in the captured image is provided via a second portion 540A-C of the display 530. The relative position, size, and shape of the first portion 550A-C and second portions 540A-C in a given display 530 can be adjusted based at least in part upon a target illumination pattern which is determined to provide a particular illumination of the image subject, a target size and shape of the displayed image of at least the image subject, etc. For example, the first portion 540 can be restricted from being too small, so that the image can be easily perceptible. In another example, the second portion 550 can be restricted from being too small, so that the target illumination of at least the image subject can be provided by the second portion 540.

FIG. 5A illustrates a device 500 where, as in some embodiments, the first portion 550A of the display in which an image captured by camera 520 is located, is centered in the display 530 while the second portion 540A which provides illumination of the image subject located in the image extends around the first portion 550 in a rough "ring" shape. The relative sizes of the first and second portions 550A, 540A can be determined by an illumination processor included in device 500, based at least in part upon the target illumination of the image subject by the second portion 540A. In the illustrated embodiment, the illumination processor can determine, based at least in part upon a low SNR of the captured image displayed in the first portion 550A, that a relatively large magnitude of light output is to be provided by portion 540A to sufficiently illuminate the image subject to result in a captured image of the subject having a sufficiently high SNR. The relative shape of the second portion 540A can be determined, by at least the illumination processor, based at least in part upon a determination that the illumination pattern is to generally illuminate the camera field of view, the image subject, some combination thereof, etc.

In the illustrated embodiment shown in FIG. 5B, while the first portion 550B is centered in the display 530 and the second portion 540B extends around the first portion, similarly to FIG. 5A, the relative sizes of the first and second portions 550B, 540B are different from FIG. 5A. In particular, the first portion 550B is substantially larger, relative to both the display 530 area and the second portion 540B, while the second portion 540B is correspondingly smaller. The illumination processor can determine, based at least in part upon a relatively higher SNR of the captured image displayed in the first portion 550B, relative to the image displayed in portion 550A shown in FIG. 5A, that a relatively small magnitude of light output is to be provided by portion 540B to sufficiently illuminate the image subject to result in a captured image of the subject having a sufficiently high SNR.

FIG. 5C illustrates a configuration of the first portion 550C and second portion 540C, in the display 530, which results in the second portion 540C selectively illuminating a particular limited portion of the camera field of view. For example, as shown, a lower portion of the image subject 552B can be sufficiently illuminated by ambient light that the SNR of the lower portion 552B at least meets an image quality threshold level, while the upper portion of the image subject 552A is insufficiently illuminated, such that a SNR o the upper portion in the image is below a threshold level. As a result, the second portion 540C can be determined to be positioned in an upper region of the display 530, so that the illumination provide by the displays screen portions in the portion 540C selectively illuminate the upper portion 552A of the image subject displayed in the captured image. The first portion 550C is correspondingly located in a lower portion of the display 530.

The relative size and position of one or more of the first portion 550 and second portion 540 in the display can be dynamically adjusted based on real-time changes in image subject illumination. For example, the display can dynamically switch between the configuration shown in FIG. 5A and the configuration shown in FIG. 5B based on real-time changes in illumination of the image subject, as determined by at least a portion of the device 500 which can include an illumination processor, which result in dynamic changes in the determined target illumination of the image subject provided by the display screen portions in display 530.

In some embodiments, the display of a device can be adjustably controlled to provide adjustable illumination of a subject via an entirety of the display 530, in the absence of any displayed image of the subject. As a result, the second portion 540 of the display can occupy an entirety of the display 530, while the first portion 550 can be absent from the display. For example, the device can be configured to selectively illuminate one or more portions of the camera field of view based at least in part upon adjustably controlling one or more of the color and the light output magnitude of the display screen light output of the entirety of the display. As a result the adjustable illumination of a subject in the camera field of view can be maximized, which can result in enhancing the signal to noise ratio (SNR) of a captured image of the image subject.

In some embodiments, the display of a device can be adjustably controlled to switch between separate illumination modes, where one mode provides both a display of captured images and adjustable illumination of a subject included in the displayed images via a light output of a limited portion of the device display, and another mode provides adjustable illumination of the subject via a light output of an entirety of the device display without displaying images captured by the camera device.

Such mode switching can be associated with operations of the camera device. For example, based at least in part upon a camera device in the device being activated, where the camera begins captures one or more first images of the camera field of view, the device display can be switched, by one or more illumination processors, to the first illumination mode, so that the device shows the captured first images in a first portion of the device display, and the light output of a second portion of the display is adjustably controlled to adjust illumination of the subject. Based at least in part upon an image capture command being received at the camera device, for example in response to a user interaction with the device which results in generation of a user command to capture a second image of the camera field of view, the device display can be switched, by one or more illumination processors, to the second illumination mode, where the device display adjustably illuminates the camera field of view via the entirety of the portions of the display screen and no image is displayed on the device display. The device can be switched to the second illumination mode concurrently with the camera device capturing the second image of the camera field of view, and the device display can be switched back to the first illumination mode based at least in part upon the camera device completing capturing the second image. As a result, the device display can "pulse" the second illumination mode, thereby providing "flash" illumination of one or more subjects in the camera field of view while the second image is captured.

In some embodiments, the magnitude of the display screen light output is increased when the device display is in the second illumination mode, relative to the display screen light output when the device display is in the first illumination mode. Where the device display "pulses" the second illumination mode concurrently with the camera device capturing the second image, the increased light output magnitude when the display is in the second mode results in a "pulse" of increased light output, thereby providing camera flash functionality. When the device display is in the second illumination mode, the light output provided by the display screen can be provided in a particular illumination pattern, which can be at least partially similar to the illumination pattern provided when the device display is in the first illumination mode. In some embodiments, the illumination pattern provided when the device display is in the second illumination mode is different from the illumination pattern provided when the device display is in the first illumination mode. In some embodiments, the light output provided by the device display in the second illumination mode is uniform, such that the color and light output magnitude of the light output provided by the various display screen portions is the same. As a result, the display can provide a uniform "flash" of light when the second illumination mode is pulsed.

Figure 6:
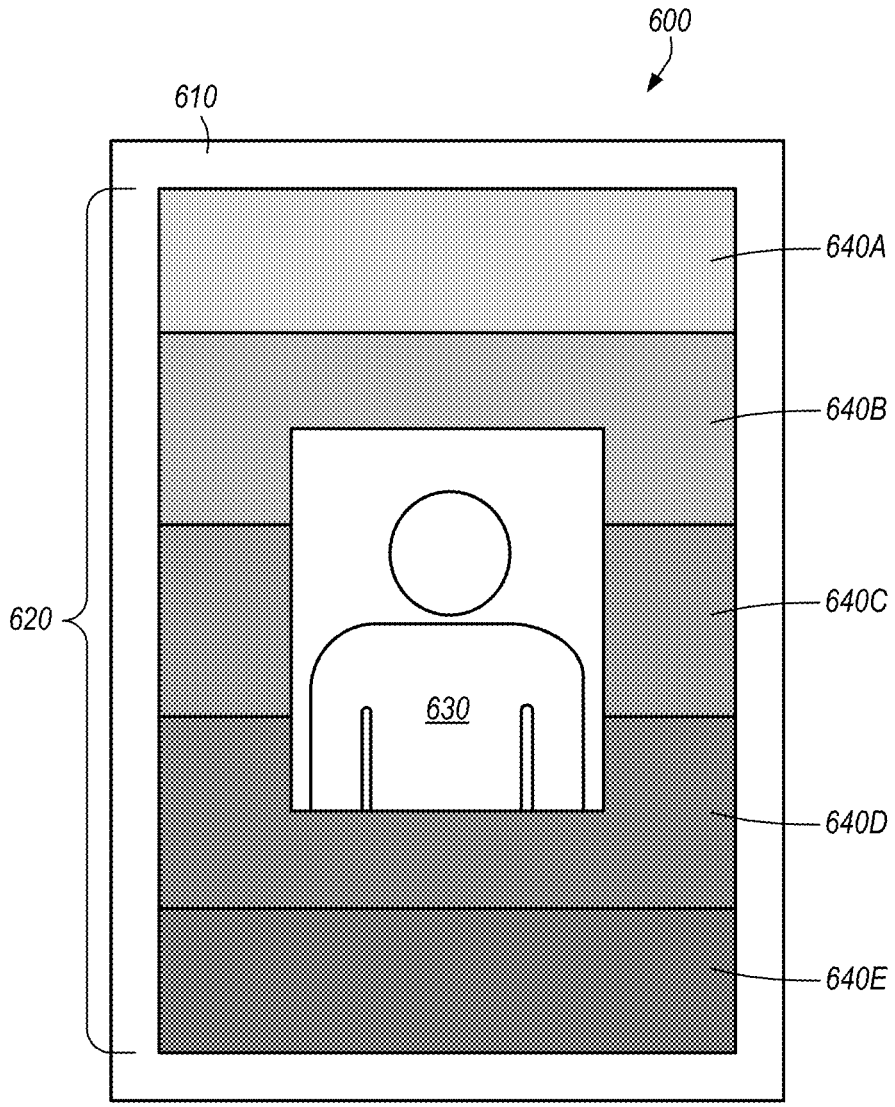
FIG. 6 illustrates a device which includes a display screen which displays an image in a limited portion of the display screen and provides variable light output in multiple other limited portions of the display screen, according to some embodiments.

FIG. 6 illustrates a device which includes a display screen which displays an image in a limited portion of the display screen and provides variable illumination in multiple other limited portions of the display screen, according to some embodiments.

In some embodiments, the display of a device can be adjustably controlled to provide adjustable illumination of a subject included an image displayed by the device display. The adjustable illumination of the subject can result in enhancing the signal to noise ratio (SNR) of the displayed image. In some embodiments, the illumination can be provided via light output provided by particular portions of the display, and the light output provided by the various display portions can be different, such that light output is provided in one or more particular patterns which provide a corresponding pattern of illumination of the image subject. The illumination pattern can be determined by an illumination processor as a pattern of illumination which optimizes image subject illuminance. The illumination pattern can include a pattern where different portions of the display provide illumination, via the display screen light output, with different magnitudes and colors. The target colors and magnitudes of the display screen light output provided by the various display screen portions can be determined based on a determination of a particular pattern of illumination, which includes a pattern of one or more of light output magnitude, light output color, etc., which at least increases image quality, which can be determined based at least in part upon image SNR.

As shown in FIG. 6, the device 600 includes a display screen 620, located in housing 610, which displays an image 630 of a subject in a first particular portion of the display screen, and which displays, in a second portion of the display screen, a pattern 640A-E of display screen light output of the subject displayed in the image 630. As shown, the first particular portion in which the image 630 is displayed is centered in the display screen 620, so that the light output pattern provided by portions 640A-E is approximately ring-shaped. Other relative positions of the first and second displays screen portions can be used and are encompassed herein.

The second display screen portion includes separate sets 640A-E of display screen portions which each provide a separate display screen light output magnitude and color. Each separate set 640A-E of display portions can include one or more particular backlight elements which are adjustably controlled to provide a target magnitude of backlight light output and one or more particular corresponding display screen portions which are adjustably controlled to filter the backlight light output provided by one or more of the corresponding backlight elements, light output emitted by one or more of the display screen portions, etc. such that the filtered light output, passing through the display screen portions as the displays screen light output, has the target displays screen light output color determined for the particular display screen portion.

Processes

Figure 7:
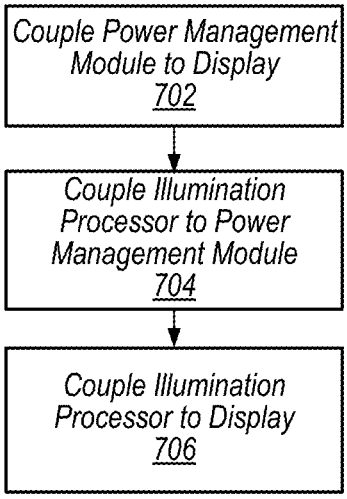
FIG. 7 illustrates a process for configuring a device to adjustably control light output of at least a portion of a backlight, according to some embodiments.

FIG. 7 illustrates a process for configuring a device to adjustably control light output of at least a portion of a display of the device, according to some embodiments. The device configured via the process shown in FIG. 7 can include any of the devices included in any of the embodiments included herein. For example, the device can include a display screen and a backlight component, coupled to the display screen, which is configured to generate a light output which passes through the display screen as a light output of the display screen. In another example, the device can include a display screen which is independent of any backlight.

At 702, a power management module is installed in the device, such that the power management module is coupled to one or more portions of a display included in the device. The one or more portions of the display can include one or more of a display screen, a backlight coupled to the display screen, some combination thereof, etc.

The power management module, in some embodiments, adjustably controls the light output emitted by a portion of the display screen, also referred to herein interchangeably as emitted luminance of the display screen portion, based at least in part upon one or more received command signals. In some embodiments, to adjustably control the emitted light output of the display screen portion, including the magnitude of the emitted light output, the power management module adjusts the amount of electrical power supplied, from one or more power sources, to one or more particular selected portions of the display screen. Adjusting the electrical power supplied to one or more portions of a display screen can include adjusting the electrical power supplied to selected display screen portions, in embodiments where the display screen includes a set of display screen portions for which the supply of electrical power thereto can be independently adjustably controlled. In some embodiments, the power management module receives electrical power supplied from one or more power sources and adjustably supplies the received electrical power to one or more selected portions of the display screen. Adjusting the supply of electrical power to one or more portions of a display screen can include adjusting a flow of electrical current to the one or more portions. In some embodiments, where a display screen includes multiple portions, the portions can include a set of pixels, such that each display screen portion includes separate one or more pixels of the set of pixels.

As described above, the device can include a backlight component which is coupled to a display screen of the device. The power management module, in some embodiments, adjustably controls the light output of the backlight component, also referred to herein interchangeably as emitted luminance of the backlight component, based at least in part upon one or more received command signals. In some embodiments, to adjustably control the light output of the backlight component, the power management module adjusts the amount of electrical power supplied, from one or more power sources, to one or more particular selected portions of the backlight component. Adjusting the electrical power supplied to one or more portions of a backlight component can include adjusting the electrical power supplied to selected backlight elements included in the backlight component, in embodiments where the backlight component includes a set of backlight elements for which the supply of electrical power thereto can be independently adjustably controlled. In some embodiments, the power management module receives electrical power supplied from one or more power sources and adjustably supplies the received electrical power to one or more selected portions of the backlight component. Adjusting the supply of electrical power to one or more portions of a backlight component can include adjusting a flow of electrical current to the one or more portions. In some embodiments, where a backlight component includes multiple backlight elements, the backlight components can include a set of LEDs, such that each backlight element includes separate one or more LEDs of the set of LEDs.

At 704, an illumination processor is installed in the device, such that the illumination processor is communicatively coupled to the power management module. The illumination processor, in some embodiments, adjustably controls the power management module, via one or more command signals transmitted by the illumination processor to the power management module, to adjustably control the light output of one or more portions of the backlight component, the light output emitted by one or more portions of the display screen, the transmittance of one or more portions of the display screen, some combination thereof, etc. The illumination processor, in some embodiments, determines a particular light output of the one or more portions of the backlight component and generates one or more command signals to the power management module that, when received at the power management module, cause the power management module to adjust the light output of the one or more portions of the backlight component to the particular light output. The illumination processor, in some embodiments, determines a particular light output of the one or more portions of the display screen and generates one or more command signals to the power management module that, when received at the power management module, cause the power management module to adjust the light output emitted by the one or more portions of the display screen to the particular light output.

Communicatively coupling the illumination processor to the power management module can include electrically coupling via one or more electrical circuits, coupling via one or more communication links, some combination thereof, etc.

In some embodiments, installing the illumination processor in the device includes communicatively coupling the illumination processor with one or more camera devices, light sensors, displays, etc.

In some embodiments, coupling the illumination processor with a display results in configuring the illumination processor to determine a color of one or more portions of the display screen and further determine a light output of the display screen based at least in part upon the display screen color and a light output of one or more of the display screen emitted light output, a light output of a coupled backlight components, a transmittance of the display screen, some combination thereof, etc. In some embodiments, the illumination processor determines a backlight light output based at least in part upon the determined display screen color and a determined amount of light output that the display screen output is required to meet. In some embodiments, the illumination processor determines a display screen emitted light output based at least in part upon the determined display screen color and a determined amount of light output that the display screen output is required to meet. In some embodiments, the illumination processor determines a display screen transmittance based at least in part upon the determined display screen color and a determined amount of light output that the display screen output is required to meet.

In some embodiments, coupling the illumination processor with one or more of a camera device results in configuring the illumination processor to determine a light output of the display screen to cause a particular magnitude of illumination of one or more subjects of an image captured by the camera device. For example, based on an image of the subject, captured by the camera and processed by the illumination processor, the illumination processor can determine a particular color of light output to illuminate the subject and a particular magnitude of light output to illuminate the subject. Based on the determinations, the illumination processor can adjust the color of one or more portions of the display screen and adjust one or more of the backlight light output of corresponding portions of the backlight component, the magnitude of light output emitted by the one or more display screen portions, the transmittance of the one or more display screen portions, etc.

At 706, the illumination processor is coupled to the display. Such coupling can include coupling the illumination processor to one or more components of the display, including one or more of a display screen, backlight, etc. The illumination processor can adjust the color of one or more portions of the display screen, determine one or more colors of one or more portions of the display screen, etc. Based on determining the color of one or more portions of the display screen, the illumination processor can adjust one or more of the backlight light output magnitude of one or more corresponding backlight elements of the backlight component, the magnitude of light output emitted by the one or more portions of the display screen, the transmittance of the one or more portions of the displays screen, some combination thereof, etc.

Figure 8:
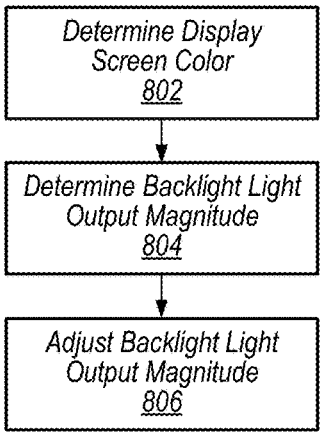
FIG. 8 illustrates a process for adjusting a light output of one or more portions of a backlight based at least in part upon a color of one or more portions of a display screen, according to some embodiments.

FIG. 8 illustrates a process for adjusting a light output of one or more portions of a backlight based at least in part upon a color of one or more portions of a display screen according to some embodiments. The process can be implemented by one or more illumination processors included in any of the embodiments of the device included herein. The illumination processor can be implemented by one or more computer systems.

At 802, the color of one or more portions of a display screen is determined. The one or more portions can include one or more selected portions, regions, zones, etc. of the display screen. For example, where an image is displayed in one region of the display screen, the color of one or more portions included in another region of the display screen is determined. In some embodiments, the other region of the display screen is a region which emits light that illuminates the subject of an image displayed in the first region of the display screen, so that the image of the subject has at least a certain level of quality, which can be indicated by a signal-to-noise ratio of one or more portions of the image.

At 804, a backlight target light output magnitude is determined. The determined backlight target light output, in some embodiments, is a determined target light output magnitude of one or more portions of the backlight component which are determined to correspond to the one or more portions of the display screen for which the color of the portions of the display screen is determined. The backlight target light output magnitude can be determined based at least in part upon a determined display screen output magnitude, where the display screen light output magnitude is based at least in part upon the display screen color and corresponding backlight portion light output magnitude. The display screen light output can include a predetermined light output magnitude and can be a fixed amount of light output. As a result, the backlight target light output magnitude can be greater than the display screen light output magnitude, where the color of the corresponding display screen portion results in filtering the backlight light output to wavelengths which have a reduced light output magnitude relative to the total backlight light output magnitude.

At 806, the backlight light output of one or more portions of the backlight component are adjusted to at least meet the target backlight light output magnitude. Such adjusting can include generating one or more command signals that, when transmitted to one or more power management modules which control electrical power supply to the one or more portions of the backlight component, cause the light output of the one or more portions to be adjusted to the target light output.

Figure 9:
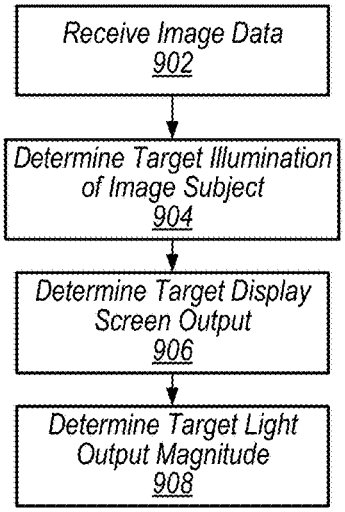
FIG. 9 illustrates a process for adjusting a light output of one or more portions of a backlight based at least in part upon a color of one or more portions of a display screen, according to some embodiments.

FIG. 9 illustrates a process for adjusting a light output of one or more portions of a backlight based at least in part upon a color of one or more portions of a display screen, according to some embodiments. The process can be implemented by one or more illumination processors included in any of the embodiments of the device included herein. The illumination processor can be implemented by one or more computer systems.

At 902, an image of an object in a scene, where the object is referred to herein interchangeably as an image "subject", is received from one or more camera devices. The camera devices, also referred to herein interchangeably as "cameras", can be included in a common device with the illumination processor. In some embodiments, processing the received image data includes displaying the image in one or more particular portions of a display screen included in the device, including a display screen which faces into the field of view of the one or more cameras which captured the image.

At 904, a target illumination of one or more image subjects included in the image is determined. The target illumination can be determined based on an illumination which results in a sufficient SNR of the image of the subject to meet a threshold SNR value, thereby resulting in the image having a sufficient level of quality. In some embodiments, determining a target illumination of the one or more image subjects includes selecting a particular image subject from the image. The selected image subject can include an image subject which is proximate to a center of the captured image, an image subject which occupies at least a threshold proportion of the image, an image subject which is determined to approximate a particular shape associated with one or more known objects, some combination thereof, etc.

At 906, a target illumination of the image subject by one or more portions of the display screen of the device is determined. Determining the target illumination can include determining a target one or more portions of the display screen to emit light, as display screen light output, which illuminates the image subject. Determining the target illumination can include, for one or more separate display screen portions, determining a particular target display screen light output magnitude and color. The one or more portions can be selected as one or more particular regions of the display screen which provide one or more particular amounts of display screen light output which achieve a particular illumination of the image subject.

At 908, a target light output provided by one or more portions of a backlight component coupled to the display screen, the one or more portions of the display screen, some combination thereof, etc. is determined. The target light output can be determined based at least in part upon the determined magnitude and color of the display screen light output determined for the one or more display screen portions.

In some embodiments, a target light output can be determined for particular selected display screen portions, which can include one or more particular display screen pixels for which a target display screen light output is determined at 906. Such a determined target light output for particular selected display screen portions can include one or more of a determined target transmittance, magnitude of emitted light output, some combination thereof, etc. For example, where a target light output, including a particular magnitude and color of the light output, is determined for a display screen light output from a particular display screen portion, a target magnitude of light output emitted by the particular display screen portion can be determined.

In some embodiments, determining the target light output of one or more display screen portions includes determining, for the display screen portion, a target magnitude of light output emitted by the display screen portion that, for the given color displayed by the display screen portion, results in a display screen light output by the display screen portion which has the determined target display screen light output color and magnitude for that particular display screen portion. In some embodiments, the target display screen light output magnitude is a fixed magnitude, such that the target magnitude of emitted light output for a display screen portion is adjusted based on a relationship between the target display screen light output magnitude, the target display screen light output color, and the display screen portion emitted light output magnitude at the particular color wavelengths of the displayed color.

In some embodiments, determining the target light output of one or more display screen portions includes determining, for the display screen portion, a target display screen portion transmittance that, for the given color displayed by the display screen portion, results in a display screen light output by the display screen portion which has the determined target display screen light output color and magnitude for that particular display screen portion. In some embodiments, the target display screen light output magnitude is a fixed magnitude, such that the target light transmittance for a display screen portion is adjusted based on a relationship between the target display screen light output magnitude, the target display screen light output color, and the display screen portion transmittance at the particular color wavelengths of the displayed color.

In some embodiments, a target light output can be determined for particular selected backlight component portions, which can include one or more particular backlight elements, which are determined to correspond to one or more particular display screen portions for which a target display screen light output is determined at 906. For example, where a target light output, including a particular magnitude and color of the light output, is determined for a display screen light output from a particular display screen portion, a target light output for a particular backlight element which corresponds to the particular display screen portion can be determined. A backlight component portion which corresponds to a particular display screen portion can include a backlight portion which emits light that passes through the display screen portion, and is at least partially filtered by the display screen portion, as display screen light output of the display screen portion.

In some embodiments, determining the target light output of one or more corresponding backlight elements includes determining, for the backlight element, a target backlight light output magnitude that, when passing through the display screen, results in a display screen light output by the display screen portion which has the determined target display screen light output color and magnitude for that particular display screen portion. In some embodiments, the target display screen light output magnitude is a fixed magnitude, such that the target backlight light output for a backlight element corresponding to a particular display screen portion is adjusted based on a relationship between the target display screen light output magnitude, the target display screen light output color, and the backlight light output magnitude at the particular color wavelengths which pass through the display screen. For example, a backlight element may emit light, as backlight light output, at different magnitudes at different color wavelengths, such that, to maintain a fixed display screen light output magnitude across various illumination colors, the backlight light output magnitude is adjusted based on the display screen light output color to accommodate variations in backlight light output magnitude variation across various color wavelengths.

Multifunction Device Examples

Embodiments of electronic devices in which embodiments of backlight components, display screens, illumination processors, power management modules, etc. as described herein may be used, user interfaces for such devices, and associated processes for using such devices are described. As noted above, in some embodiments, a backlight is included in a wireless communication device. In some embodiments, the wireless communication device included in any of the above embodiments includes a portable communications device, such as a mobile telephone, that also contains other functions, such as PDA and/or music player functions. Other portable electronic devices, such as laptops, cell phones, headset devices, pad devices, tablet computers with touch-sensitive surfaces (e.g., touch screen displays and/or touch pads), wearable devices (e.g., a computer system incorporated into an article of clothing including hats, shoes, shirts, pants, etc.; a wristwatch-type device which can be worn on a forearm, upper arm, leg, etc. and can include a user interface which can include one or more touch-sensitive surfaces), some combination thereof, or the like may also be used. It should also be understood that, in some embodiments, the device is not a portable communications device, but is a desktop computer with a touch-sensitive surface (e.g., a touch screen display and/or a touch pad). In some embodiments, the device is a gaming computer with orientation sensors (e.g., orientation sensors in a gaming controller). In other embodiments, the device is not a portable communications device, but is a camera device.

In the discussion that follows, an electronic device that includes a display and a touch-sensitive surface is described. It should be understood, however, that the electronic device may include one or more other physical user-interface devices, such as a physical keyboard, a mouse and/or a joystick.

The device typically supports a variety of applications, such as one or more of the following: an ad hoc voice communication application, a drawing application, a presentation application, a word processing application, a website creation application, a disk authoring application, a spreadsheet application, a gaming application, a telephone application, a video conferencing application, an e-mail application, an instant messaging application, a workout support application, a photo management application, a digital camera application, a digital video camera application, a web browsing application, a digital music player application, and/or a digital video player application.

The various applications that may be executed on the device may use at least one common physical user-interface device, such as the touch-sensitive surface. One or more functions of the touch-sensitive surface as well as corresponding information displayed on the device may be adjusted and/or varied from one application to the next and/or within a respective application. In this way, a common physical architecture (such as the touch-sensitive surface) of the device may support the variety of applications with user interfaces that are intuitive and transparent to the user.

Figure 10:
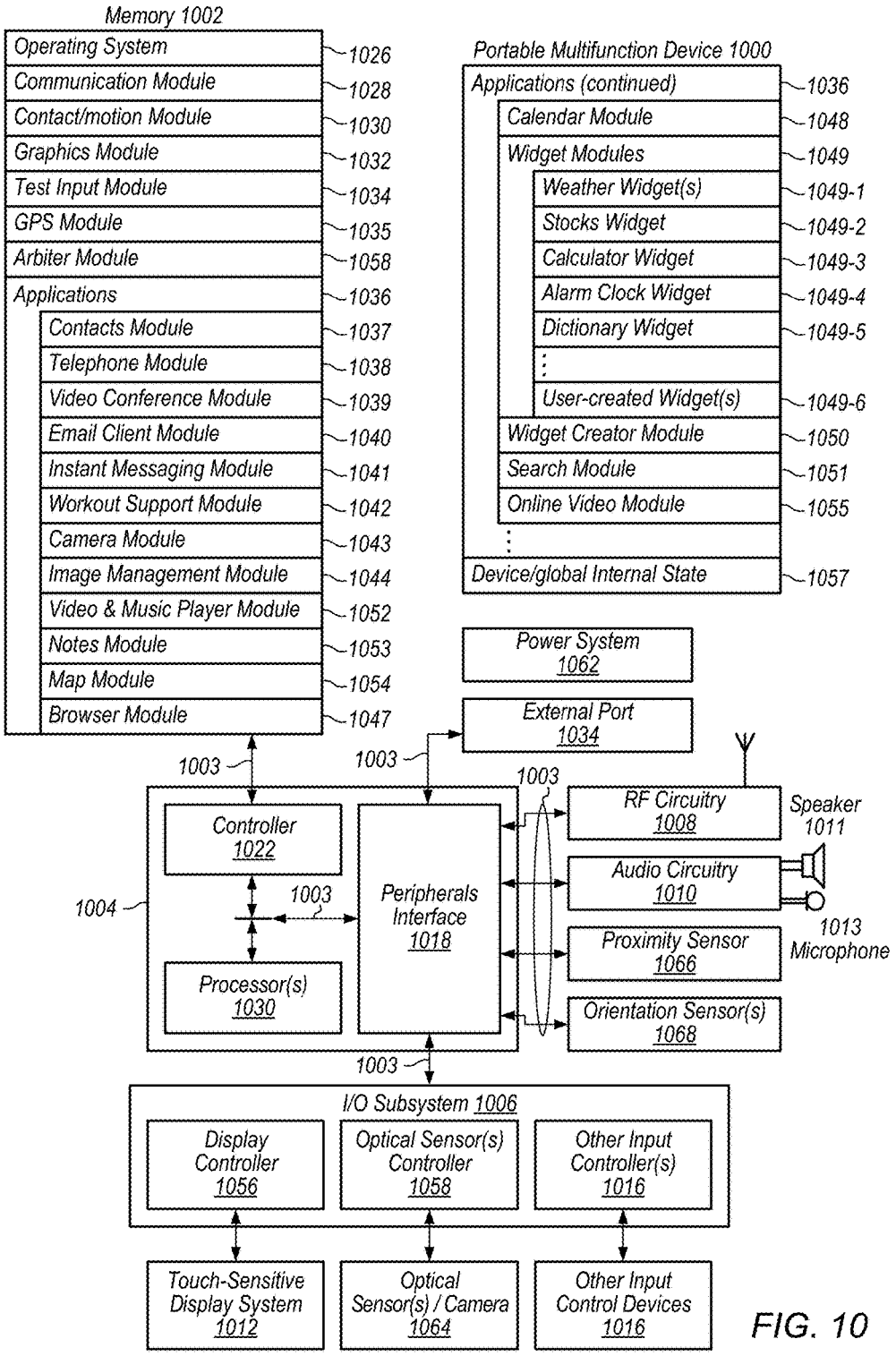
FIG. 10 is a block diagram illustrating portable multifunction device in accordance with some embodiments.

Attention is now directed toward embodiments of portable devices with cameras. FIG. 10 is a block diagram illustrating portable multifunction device 1000 in accordance with some embodiments. Embodiments of a wireless communication device, as illustrated in at least FIG. 1-6, may be included in device 1000.

Device 1000 may include memory 1002 (which may include one or more computer readable storage mediums), memory controller 1022, one or more processing units (CPU's) 1020, peripherals interface 1018, RF circuitry 1008, audio circuitry 1010, speaker 1011, touch-sensitive display system 1012, microphone 1013, input/output (I/O) subsystem 1006, other input or control devices 1016, and external port 1024. Device 1000 may include one or more optical sensors 1064. These components may communicate over one or more communication buses or signal lines 1003.

It should be appreciated that device 1000 is only one example of a portable multifunction device, and that device 1000 may have more or fewer components than shown, may combine two or more components, or may have a different configuration or arrangement of the components. The various components shown in FIG. 10 may be implemented in hardware, software, or a combination of hardware and software, including one or more signal processing and/or application specific integrated circuits.

Memory 1002 may include high-speed random access memory and may also include non-volatile memory, such as one or more magnetic disk storage devices, flash memory devices, or other non-volatile solid-state memory devices. Access to memory 1002 by other components of device 1000, such as CPU 1020 and the peripherals interface 1018, may be controlled by memory controller 1022.

Peripherals interface 1018 can be used to couple input and output peripherals of the device to CPU 1020 and memory 1002. The one or more processors 1020 run or execute various software programs and/or sets of instructions stored in memory 1002 to perform various functions for device 1000 and to process data.

In some embodiments, peripherals interface 1018, CPU 1020, and memory controller 1022 may be implemented on a single chip, such as chip 1004. In some other embodiments, they may be implemented on separate chips.

RF (radio frequency) circuitry 1008 receives and sends RF signals, also called electromagnetic signals. RF circuitry 1008 converts electrical signals to/from electromagnetic signals and communicates with communications networks and other communications devices via the electromagnetic signals. RF circuitry 1008 may include well-known circuitry for performing these functions, including but not limited to an antenna system, an RF transceiver, wireless communication transceiver, one or more amplifiers, a tuner, one or more oscillators, a digital signal processor, a CODEC chipset, a subscriber identity module (SIM) card, memory, and so forth. RF circuitry 1008 may communicate with networks, such as the Internet, also referred to as the World Wide Web (WWW), an intranet and/or a wireless network, such as a cellular telephone network, a wireless local area network (LAN) and/or a metropolitan area network (MAN), and other devices by wireless communication. The wireless communication may use any of a variety of communications standards, protocols and technologies, including but not limited to Global System for Mobile Communications (GSM), Enhanced Data GSM Environment (EDGE), high-speed downlink packet access (HSDPA), high-speed uplink packet access (HSUPA), wideband code division multiple access (W-CDMA), code division multiple access (CDMA), time division multiple access (TDMA), Bluetooth, Wireless Fidelity (Wi-Fi) (e.g., IEEE 802.11a, IEEE 802.11b, IEEE 802.11g and/or IEEE 802.11n), voice over Internet Protocol (VoIP), Wi-MAX, a protocol for e-mail (e.g., Internet message access protocol (IMAP) and/or post office protocol (POP)), instant messaging (e.g., extensible messaging and presence protocol (XMPP), Session Initiation Protocol for Instant Messaging and Presence Leveraging Extensions (SIMPLE), Instant Messaging and Presence Service (IMPS)), and/or Short Message Service (SMS), or any other suitable communication protocol, including communication protocols not yet developed as of the filing date of this document. In some embodiments, RF circuitry 1008 may establish one or more wireless ad hoc network links, and exchange signals over same, with one or more remote devices. Such ad hoc communication includes point-to-point wireless ad hoc communication, including communication over one or more wireless ad hoc network links. A wireless ad hoc network link can include a mobile ad hoc network link.

Audio circuitry 1010, speaker 1011, and microphone 1013 provide an audio interface between a user and device 1000. Audio circuitry 1010, which can include one or more audio communication interfaces, receives audio data from peripherals interface 1018, converts the audio data to an electrical signal, and transmits the electrical signal to speaker 1011. Speaker 1011 converts the electrical signal to human-audible sound waves. Audio circuitry 1010 also receives electrical signals converted by microphone 1013 from sound waves. Audio circuitry 1010 converts the electrical signal to audio data and transmits the audio data to peripherals interface 1018 for processing. Audio data may be retrieved from and/or transmitted to memory 112 and/or RF circuitry 1008 by peripherals interface 1018. In some embodiments, audio circuitry 1010 also includes a headset jack (e.g., 1112, FIG. 11). The headset jack provides an interface between audio circuitry 1010 and removable audio input/output peripherals, such as output-only headphones or a headset with both output (e.g., a headphone for one or both ears) and input (e.g., a microphone).

I/O subsystem 1006 couples input/output peripherals on device 1000, such as touch screen 1012 and other input control devices 1016, to peripherals interface 1018. I/O subsystem 1006 may include display controller 1056 and one or more input controllers 1060 for other input or control devices. The one or more input controllers 160 receive/send electrical signals from/to other input or control devices 1016. The other input control devices 1016 may include physical buttons (e.g., push buttons, rocker buttons, etc.), dials, slider switches, joysticks, click wheels, and so forth. In some alternative embodiments, input controller(s) 1060 may be coupled to any (or none) of the following: a keyboard, infrared port, USB port, and a pointer device such as a mouse. The one or more buttons (e.g., 1108, FIG. 11) may include an up/down button for volume control of speaker 1011 and/or microphone 1013. The one or more buttons may include a push button (e.g., 1106, FIG. 11).

Touch-sensitive display 1012 provides an input interface and an output interface between the device and a user. Display controller 1056 receives and/or sends electrical signals from/to touch screen 1012. Touch screen 1012 displays visual output to the user. The visual output may include graphics, text, icons, video, and any combination thereof (collectively termed "graphics"). In some embodiments, some or all of the visual output may correspond to user-interface objects.

Touch screen 1012 has a touch-sensitive surface, sensor or set of sensors that accepts input from the user based on haptic and/or tactile contact. Touch screen 1012 and display controller 1056 (along with any associated modules and/or sets of instructions in memory 1002) detect contact (and any movement or breaking of the contact) on touch screen 1012 and converts the detected contact into interaction with user-interface objects (e.g., one or more soft keys, icons, web pages or images) that are displayed on touch screen 1012. In an example embodiment, a point of contact between touch screen 1012 and the user corresponds to a finger of the user.

Touch screen 1012 may use LCD (liquid crystal display) technology, LPD (light emitting polymer display) technology, or LED (light emitting diode) technology, although other display technologies may be used in other embodiments. Touch screen 1012 and display controller 1056 may detect contact and any movement or breaking thereof using any of a variety of touch sensing technologies now known or later developed, including but not limited to capacitive, resistive, infrared, and surface acoustic wave technologies, as well as other proximity sensor arrays or other elements for determining one or more points of contact with touch screen 1012. In an example embodiment, projected mutual capacitance sensing technology may be used.

Touch screen 1012 may have a video resolution in excess of 110 dots per inch (dpi). In some embodiments, the touch screen has a video resolution of approximately 160 dpi. The user may make contact with touch screen 1012 using any suitable object or appendage, such as a stylus, a finger, and so forth. In some embodiments, the user interface is designed to work primarily with finger-based contacts and gestures, which can be less precise than stylus-based input due to the larger area of contact of a finger on the touch screen. In some embodiments, the device translates the rough finger-based input into a precise pointer/cursor position or command for performing the actions desired by the user.

In some embodiments, in addition to the touch screen, device 1000 may include a touchpad (not shown) for activating or deactivating particular functions. In some embodiments, the touchpad is a touch-sensitive area of the device that, unlike the touch screen, does not display visual output. The touchpad may be a touch-sensitive surface that is separate from touch screen 1012 or an extension of the touch-sensitive surface formed by the touch screen.

Device 1000 also includes power system 1062 for powering the various components. Power system 1062 may include a power management system, one or more power sources (e.g., battery, alternating current (AC)), a recharging system, a power failure detection circuit, a power converter or inverter, a power status indicator (e.g., a light-emitting diode (LED)) and any other components associated with the generation, management and distribution of power in portable devices.

Device 1000 may also include one or more optical sensors or cameras 1064. FIG. 10 shows an optical sensor coupled to optical sensor controller 1058 in I/O subsystem 1006. Optical sensor 1064 may include charge-coupled device (CCD) or complementary metal-oxide semiconductor (CMOS) phototransistors. Optical sensor 1064 receives light from the environment, projected through one or more lens, and converts the light to data representing an image. In conjunction with imaging module 1043 (also called a camera module), optical sensor 1064 may capture still images or video. In some embodiments, an optical sensor is located on the back of device 1000, opposite touch screen display 1012 on the front of the device, so that the touch screen display may be used as a viewfinder for still and/or video image acquisition. In some embodiments, another optical sensor is located on the front of the device so that the user's image may be obtained for videoconferencing while the user views the other videoconference participants on the touch screen display.

Device 1000 may also include one or more proximity sensors 1066. FIG. 10 shows proximity sensor 1066 coupled to peripherals interface 1018. Alternatively, proximity sensor 1066 may be coupled to input controller 1060 in I/O subsystem 1006. In some embodiments, the proximity sensor turns off and disables touch screen 1012 when the multifunction device is placed near the user's ear (e.g., when the user is making a phone call).

Device 1000 includes one or more orientation sensors 1068. In some embodiments, the one or more orientation sensors include one or more accelerometers (e.g., one or more linear accelerometers and/or one or more rotational accelerometers). In some embodiments, the one or more orientation sensors include one or more gyroscopes. In some embodiments, the one or more orientation sensors include one or more magnetometers. In some embodiments, the one or more orientation sensors include one or more of global positioning system (GPS), Global Navigation Satellite System (GLONASS), and/or other global navigation system receivers. The GPS, GLONASS, and/or other global navigation system receivers may be used for obtaining information concerning the location and orientation (e.g., portrait or landscape) of device 1000. In some embodiments, the one or more orientation sensors include any combination of orientation/rotation sensors. FIG. 10 shows the one or more orientation sensors 1068 coupled to peripherals interface 1018. Alternatively, the one or more orientation sensors 1068 may be coupled to an input controller 1060 in I/O subsystem 1006. In some embodiments, information is displayed on the touch screen display in a portrait view or a landscape view based on an analysis of data received from the one or more orientation sensors.

In some embodiments, the software components stored in memory 1002 include operating system 1026, communication module (or set of instructions) 1028, contact/motion module (or set of instructions) 1030, graphics module (or set of instructions) 1032, text input module (or set of instructions) 1034, Global Positioning System (GPS) module (or set of instructions) 1035, arbiter module 1057 and applications (or sets of instructions) 1036. Furthermore, in some embodiments memory 1002 stores device/global internal state 1057. Device/global internal state 1057 includes one or more of: active application state, indicating which applications, if any, are currently active; display state, indicating what applications, views or other information occupy various regions of touch screen display 1012; sensor state, including information obtained from the device's various sensors and input control devices 1016; and location information concerning the device's location and/or attitude.

Operating system 1026 (e.g., Darwin, RTXC, LINUX, UNIX, OS X, WINDOWS, or an embedded operating system such as VxWorks) includes various software components and/or drivers for controlling and managing general system tasks (e.g., memory management, storage device control, power management, etc.) and facilitates communication between various hardware and software components.

Communication module 1028 facilitates communication with other devices over one or more external ports 1024 and also includes various software components for handling data received by RF circuitry 1008 and/or external port 1024. External port 1024 (e.g., Universal Serial Bus (USB), FIREWIRE, etc.) is adapted for coupling directly to other devices or indirectly over a network (e.g., the Internet, wireless LAN, etc.).

Contact/motion module 1030 may detect contact with touch screen 1012 (in conjunction with display controller 1056) and other touch sensitive devices (e.g., a touchpad or physical click wheel). Contact/motion module 1030 includes various software components for performing various operations related to detection of contact, such as determining if contact has occurred (e.g., detecting a finger-down event), determining if there is movement of the contact and tracking the movement across the touch-sensitive surface (e.g., detecting one or more finger-dragging events), and determining if the contact has ceased (e.g., detecting a finger-up event or a break in contact). Contact/motion module 1030 receives contact data from the touch-sensitive surface. Determining movement of the point of contact, which is represented by a series of contact data, may include determining speed (magnitude), velocity (magnitude and direction), and/or an acceleration (a change in magnitude and/or direction) of the point of contact. These operations may be applied to single contacts (e.g., one finger contacts) or to multiple simultaneous contacts (e.g., "multitouch"/multiple finger contacts). In some embodiments, contact/motion module 1030 and display controller 1056 detect contact on a touchpad.

Contact/motion module 1030 may detect a gesture input by a user. Different gestures on the touch-sensitive surface have different contact patterns. Thus, a gesture may be detected by detecting a particular contact pattern. For example, detecting a finger tap gesture includes detecting a finger-down event followed by detecting a finger-up (lift off) event at the same position (or substantially the same position) as the finger-down event (e.g., at the position of an icon). As another example, detecting a finger swipe gesture on the touch-sensitive surface includes detecting a finger-down event followed by detecting one or more finger-dragging events, and subsequently followed by detecting a finger-up (lift off) event.

Graphics module 1032 includes various known software components for rendering and displaying graphics on touch screen 1012 or other display, including components for changing the intensity of graphics that are displayed. As used herein, the term "graphics" includes any object that can be displayed to a user, including without limitation text, web pages, icons (such as user-interface objects including soft keys), digital images, videos, animations and the like.

In some embodiments, graphics module 1032 stores data representing graphics to be used. Each graphic may be assigned a corresponding code. Graphics module 1032 receives, from applications etc., one or more codes specifying graphics to be displayed along with, if necessary, coordinate data and other graphic property data, and then generates screen image data to output to display controller 1056.

Text input module 1034, which may be a component of graphics module 1032, provides soft keyboards for entering text in various applications (e.g., contacts 1037, e-mail 1040, IM 141, browser 1047, and any other application that needs text input).

GPS module 1035 determines the location of the device and provides this information for use in various applications (e.g., to telephone 1038 for use in location-based dialing, to camera module 1043 as picture/video metadata, and to applications that provide location-based services such as weather widgets, local yellow page widgets, and map/navigation widgets).

Applications 1036 may include the following modules (or sets of instructions), or a subset or superset thereof:

- contacts module 1037 (sometimes called an address book or contact list);
- telephone module 1038;
- video conferencing module 1039;
- e-mail client module 1040;
- instant messaging (IM) module 1041;
- workout support module 1042;
- camera module 1043 for still and/or video images;
- image management module 1044;
- browser module 1047;
- calendar module 1048;
- widget modules 1049, which may include one or more of: weather widget 1049-1, stocks widget 1049-2, calculator widget 1049-3, alarm clock widget 1049-4, dictionary widget 1049-5, and other widgets obtained by the user, as well as user-created widgets 1049-6;
- widget creator module 1050 for making user-created widgets 1049-6;
- search module 1051;
- video and music player module 1052, which may be made up of a video player
- module and a music player module;
- notes module 1053;
- map module 1054; and/or
- online video module 1055.

Examples of other applications 1036 that may be stored in memory 1002 include other word processing applications, other image editing applications, drawing applications, presentation applications, JAVA-enabled applications, encryption, digital rights management, voice recognition, and voice replication.

In conjunction with touch screen 1012, display controller 1056, contact module 1030, graphics module 1032, and text input module 1034, contacts module 1037 may be used to manage an address book or contact list (e.g., stored in application internal state 1092 of contacts module 1037 in memory 1002), including: adding name(s) to the address book; deleting name(s) from the address book; associating telephone number(s), e-mail address(es), physical address (es) or other information with a name; associating an image with a name; categorizing and sorting names; providing telephone numbers or e-mail addresses to initiate and/or facilitate communications by telephone 1038, video conference 1039, e-mail 1040, or IM 1041; and so forth.

In conjunction with RF circuitry 1008, audio circuitry 1010, speaker 1011, microphone 1013, touch screen 1012, display controller 1056, contact module 1030, graphics module 1032, and text input module 1034, telephone module 1038 may be used to enter a sequence of characters corresponding to a telephone number, access one or more telephone numbers in address book 1037, modify a telephone number that has been entered, dial a respective telephone number, conduct a conversation and disconnect or hang up when the conversation is completed. As noted above, the wireless communication may use any of a variety of communications standards, protocols and technologies.

In conjunction with RF circuitry 1008, audio circuitry 1010, speaker 1011, microphone 1013, touch screen 1012, display controller 1056, optical sensor 1064, optical sensor controller 1058, contact module 1030, graphics module 1032, text input module 1034, contact list 1037, and telephone module 1038, videoconferencing module 109 includes executable instructions to initiate, conduct, and terminate a video conference between a user and one or more other participants in accordance with user instructions.

In conjunction with RF circuitry 1008, touch screen 1012, display controller 1056, contact module 1030, graphics module 1032, and text input module 1034, e-mail client module 1040 includes executable instructions to create, send, receive, and manage e-mail in response to user instructions. In conjunction with image management module 1044, e-mail client module 1040 makes it very easy to create and send e-mails with still or video images taken with camera module 1043.

In conjunction with RF circuitry 1008, touch screen 1012, display controller 1056, contact module 1030, graphics module 1032, and text input module 1034, the instant messaging module 1041 includes executable instructions to enter a sequence of characters corresponding to an instant message, to modify previously entered characters, to transmit a respective instant message (for example, using a Short Message Service (SMS) or Multimedia Message Service (MMS) protocol for telephony-based instant messages or using XMPP, SIMPLE, or IMPS for Internet-based instant messages), to receive instant messages and to view received instant messages. In some embodiments, transmitted and/or received instant messages may include graphics, photos, audio files, video files and/or other attachments as are supported in a MMS and/or an Enhanced Messaging Service (EMS). As used herein, "instant messaging" refers to both telephony-based messages (e.g., messages sent using SMS or MMS) and Internet-based messages (e.g., messages sent using XMPP, SIMPLE, or IMPS).

In conjunction with RF circuitry 1008, touch screen 1012, display controller 1056, contact module 1030, graphics module 1032, text input module 1034, GPS module 1035, map module 1054, and music player module 1046, workout support module 1042 includes executable instructions to create workouts (e.g., with time, distance, and/or calorie burning goals); communicate with workout sensors (sports devices); receive workout sensor data; calibrate sensors used to monitor a workout; select and play music for a workout; and display, store and transmit workout data.

In conjunction with touch screen 1012, display controller 1056, optical sensor(s) 1064, optical sensor controller 1058, contact module 1030, graphics module 1032, and image management module 1044, camera module 1043 includes executable instructions to capture still images or video (including a video stream) and store them into memory 1002, modify characteristics of a still image or video, or delete a still image or video from memory 1002.

In conjunction with touch screen 1012, display controller 1056, contact module 1030, graphics module 1032, text input module 1034, and camera module 1043, image management module 1044 includes executable instructions to arrange, modify (e.g., edit), or otherwise manipulate, label, delete, present (e.g., in a digital slide show or album), and store still and/or video images.

In conjunction with RF circuitry 1008, touch screen 1012, display system controller 1056, contact module 1030, graphics module 1032, and text input module 1034, browser module 1047 includes executable instructions to browse the Internet in accordance with user instructions, including searching, linking to, receiving, and displaying web pages or portions thereof, as well as attachments and other files linked to web pages.

In conjunction with RF circuitry 1008, touch screen 1012, display system controller 1056, contact module 1030, graphics module 1032, text input module 1034, e-mail client module 1040, and browser module 1047, calendar module 1048 includes executable instructions to create, display, modify, and store calendars and data associated with calendars (e.g., calendar entries, to do lists, etc.) in accordance with user instructions.

In conjunction with RF circuitry 1008, touch screen 1012, display system controller 1056, contact module 1030, graphics module 1032, text input module 1034, and browser module 1047, widget modules 1049 are mini-applications that may be downloaded and used by a user (e.g., weather widget 1049-1, stocks widget 1049-2, calculator widget 10493, alarm clock widget 1049-4, and dictionary widget 1049-5) or created by the user (e.g., user-created widget 1049-6). In some embodiments, a widget includes an HTML (Hypertext Markup Language) file, a CSS (Cascading Style Sheets) file, and a JavaScript file. In some embodiments, a widget includes an XML (Extensible Markup Language) file and a JavaScript file (e.g., Yahoo! Widgets).

In conjunction with RF circuitry 1008, touch screen 1012, display system controller 1056, contact module 1030, graphics module 1032, text input module 1034, and browser module 1047, the widget creator module 1050 may be used by a user to create widgets (e.g., turning a user-specified portion of a web page into a widget).

In conjunction with touch screen 1012, display system controller 1056, contact module 1030, graphics module 1032, and text input module 1034, search module 1051 includes executable instructions to search for text, music, sound, image, video, and/or other files in memory 1002 that match one or more search criteria (e.g., one or more user-specified search terms) in accordance with user instructions.

In conjunction with touch screen 1012, display system controller 1056, contact module 1030, graphics module 1032, audio circuitry 1010, speaker 1011, RF circuitry 1008, and browser module 1047, video and music player module 1052 includes executable instructions that allow the user to download and play back recorded music and other sound files stored in one or more file formats, such as MP3 or AAC files, and executable instructions to display, present or otherwise play back videos (e.g., on touch screen 1012 or on an external, connected display via external port 1024). In some embodiments, device 1000 may include the functionality of an MP3 player.

In conjunction with touch screen 1012, display controller 1056, contact module 1030, graphics module 1032, and text input module 1034, notes module 1053 includes executable instructions to create and manage notes, to do lists, and the like in accordance with user instructions.

In conjunction with RF circuitry 1008, touch screen 1012, display system controller 1056, contact module 1030, graphics module 1032, text input module 1034, GPS module 1035, and browser module 1047, map module 1054 may be used to receive, display, modify, and store maps and data associated with maps (e.g., driving directions; data on stores and other points of interest at or near a particular location; and other location-based data) in accordance with user instructions.

In conjunction with touch screen 1012, display system controller 1056, contact module 1030, graphics module 1032, audio circuitry 1010, speaker 1011, RF circuitry 1008, text input module 1034, e-mail client module 1040, and browser module 1047, online video module 1055 includes instructions that allow the user to access, browse, receive (e.g., by streaming and/or download), play back (e.g., on the touch screen or on an external, connected display via external port 1024), send an e-mail with a link to a particular online video, and otherwise manage online videos in one or more file formats, such as H.264. In some embodiments, instant messaging module 1041, rather than e-mail client module 1040, is used to send a link to a particular online video.

Each of the above identified modules and applications correspond to a set of executable instructions for performing one or more functions described above and the methods described in this application (e.g., the computer-implemented methods and other information processing methods described herein). These modules (i.e., sets of instructions) need not be implemented as separate software programs, procedures or modules, and thus various subsets of these modules may be combined or otherwise re-arranged in various embodiments. In some embodiments, memory 1002 may store a subset of the modules and data structures identified above. Furthermore, memory 1002 may store additional modules and data structures not described above.

In some embodiments, device 1000 is a device where operation of a predefined set of functions on the device is performed exclusively through a touch screen and/or a touchpad. By using a touch screen and/or a touchpad as the primary input control device for operation of device 1000, the number of physical input control devices (such as push buttons, dials, and the like) on device 1000 may be reduced.

The predefined set of functions that may be performed exclusively through a touch screen and/or a touchpad include navigation between user interfaces. In some embodiments, the touchpad, when touched by the user, navigates device 1000 to a main, home, or root menu from any user interface that may be displayed on device 1000. In such embodiments, the touchpad may be referred to as a "menu button." In some other embodiments, the menu button may be a physical push button or other physical input control device instead of a touchpad.

Figure 11:
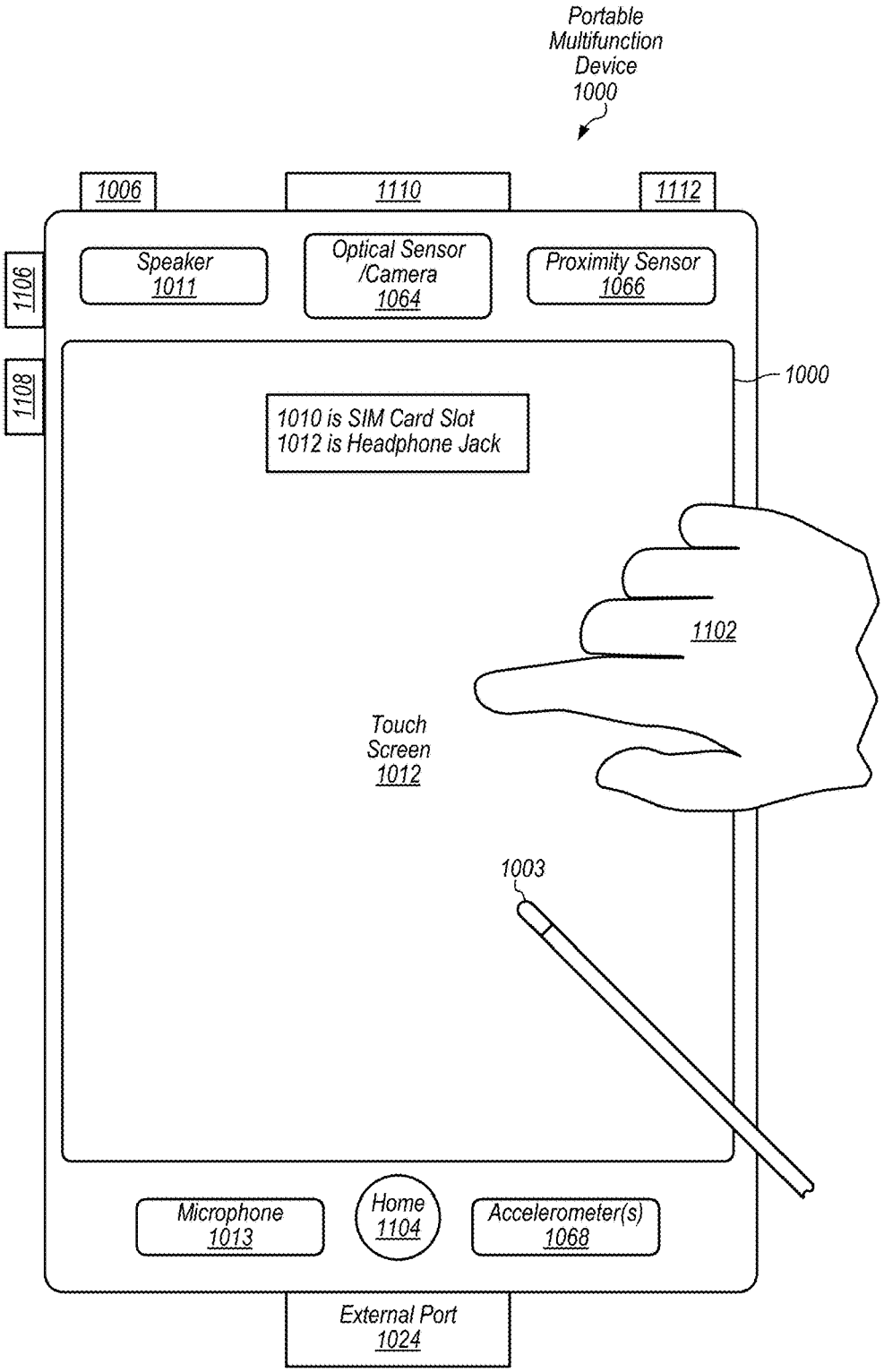
FIG. 11 illustrates a portable multifunction device having a touch screen in accordance with some embodiments.

FIG. 11 illustrates a portable multifunction device 1000 having a touch screen 1012 in accordance with some embodiments. The touch screen may display one or more graphics, also referred to herein as graphical representations, icons, etc., within user interface (UI) 1100. UI 1100 can include a graphical user interface (GUI). In this embodiment, as well as others described below, a user may select one or more of the graphics by making a gesture on the graphics, for example, with one or more fingers 1102 (not drawn to scale in the Figure) or one or more styluses 1103 (not drawn to scale in the figure).

Device 1000 may also include one or more physical buttons, such as "home" or menu button 1104. As described previously, menu button 1104 may be used to navigate to any application 1036 in a set of applications that may be executed on device 1000. Alternatively, in some embodiments, the menu button is implemented as a soft key in a graphics user interface (GUI) displayed on touch screen 1012.

In one embodiment, device 1000 includes touch screen 1012, menu button 1104, push button 1106 for powering the device on/off and locking the device, volume adjustment button(s) 1108, Subscriber Identity Module (SIM) card slot 1110, head set jack 1112, and docking/charging external port 1024. Push button 1106 may be used to turn the power on/off on the device by depressing the button and holding the button in the depressed state for a predefined time interval; to lock the device by depressing the button and releasing the button before the predefined time interval has elapsed; and/or to unlock the device or initiate an unlock process. In an alternative embodiment, device 1000 also may accept verbal input for activation or deactivation of some functions through microphone 1013.

It should be noted that, although many of the examples herein are given with reference to optical sensor/camera 1064 (on the front of a device), a rear-facing camera or optical sensor that is pointed opposite from the display may be used instead of or in addition to an optical sensor/camera 1064 on the front of a device.

Example Computer System

Figure 12:
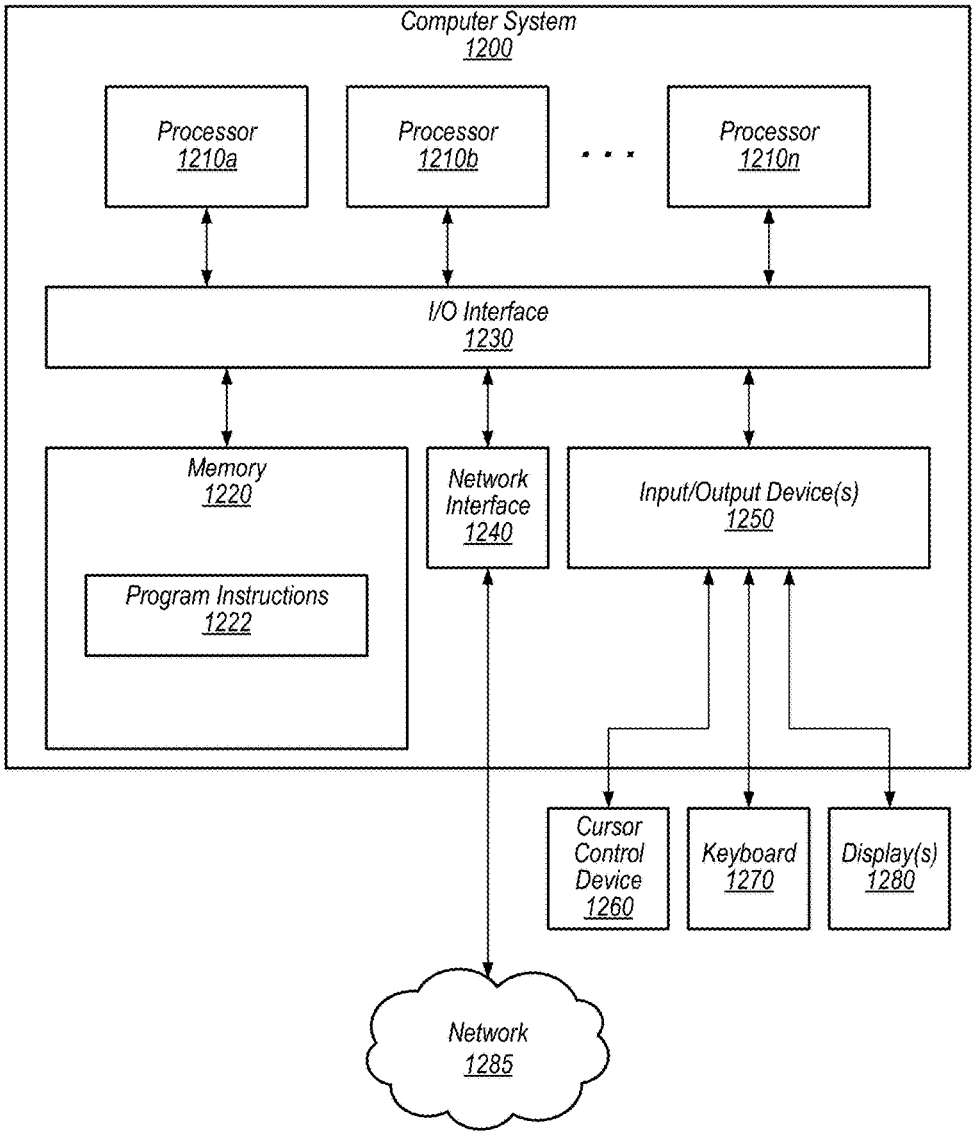
FIG. 12 illustrates an example computer system that may be configured to include or execute any or all of the embodiments described above.

FIG. 12 illustrates an example computer system 1200 that may be configured to include or execute any or all of the embodiments described above. In different embodiments, computer system 1200 may be any of various types of devices, including, but not limited to, a personal computer system, desktop computer, laptop, notebook, tablet, slate, pad, or netbook computer, cell phone, smartphone, PDA, portable media device, mainframe computer system, handheld computer, workstation, network computer, a camera or video camera, a set top box, a mobile device, a consumer device, video game console, handheld video game device, application server, storage device, a television, a video recording device, a peripheral device such as a switch, modem, router, or in general any type of computing or electronic device.

Various embodiments of a device configured to provide adjustable illumination, as described herein, may be executed in one or more computer systems 1200, which may interact with various other devices. Note that any component, action, or functionality described above with respect to FIGS. 1 through 11 may be implemented on one or more computers configured as computer system 1200 of FIG. 12, according to various embodiments. In the illustrated embodiment, computer system 1200 includes one or more processors 1210 coupled to a system memory 1220 via an input/output (I/O) interface 1230. Computer system 1200 further includes a network interface 1240 coupled to I/O interface 1230, and one or more input/output devices 1250, such as cursor control device 1260, keyboard 1270, and display(s) 1280. In some cases, it is contemplated that embodiments may be implemented using a single instance of computer system 1200, while in other embodiments multiple such systems, or multiple nodes making up computer system 1200, may be configured to host different portions or instances of embodiments. For example, in one embodiment some elements may be implemented via one or more nodes of computer system 1200 that are distinct from those nodes implementing other elements.

In various embodiments, computer system 1200 may be a uniprocessor system including one processor 1210, or a multiprocessor system including several processors 1210 (e.g., two, four, eight, or another suitable number). Processors 1210 may be any suitable processor capable of executing instructions. For example, in various embodiments processors 1210 may be general-purpose or embedded processors implementing any of a variety of instruction set architectures (ISAs), such as the x86, PowerPC, SPARC, or MIPS ISAs, or any other suitable ISA. In multiprocessor systems, each of processors 1210 may commonly, but not necessarily, implement the same ISA.

System memory 1220 may be configured to store camera control program instructions 1222 and/or voice communication control data accessible by processor 1210. In various embodiments, system memory 1220 may be implemented using any suitable memory technology, such as static random access memory (SRAM), synchronous dynamic RAM (SDRAM), nonvolatile/Flash-type memory, or any other type of memory. In the illustrated embodiment, program instructions 1222 may be configured to implement an adjustable display illumination process incorporating any of the functionality described above. Additionally, program instructions 1222 of memory 1220 may include any of the information or data structures described above. In some embodiments, program instructions and/or data may be received, sent or stored upon different types of computer-accessible media or on similar media separate from system memory 1220 or computer system 1200. While computer system 1200 is described as implementing the functionality of functional blocks of previous Figures, any of the functionality described herein may be implemented via such a computer system.

In one embodiment, I/O interface 1230 may be configured to coordinate I/O traffic between processor 1210, system memory 1220, and any peripheral devices in the device, including network interface 1240 or other peripheral interfaces, such as input/output devices 1250. In some embodiments, I/O interface 1230 may perform any necessary protocol, timing or other data transformations to convert data signals from one component (e.g., system memory 1220) into a format suitable for use by another component (e.g., processor 1210). In some embodiments, I/O interface 1230 may include support for devices attached through various types of peripheral buses, such as a variant of the Peripheral Component Interconnect (PCI) bus standard or the Universal Serial Bus (USB) standard, for example. In some embodiments, the function of I/O interface 1230 may be split into two or more separate components, such as a north bridge and a south bridge, for example. Also, in some embodiments some or all of the functionality of I/O interface 1230, such as an interface to system memory 1220, may be incorporated directly into processor 1210.

Network interface 1240 may be configured to allow data to be exchanged between computer system 1200 and other devices attached to a network 1285 (e.g., carrier or agent devices) or between nodes of computer system 1200. Network 1285 may in various embodiments include one or more networks including but not limited to Local Area Networks (LANs) (e.g., an Ethernet or corporate network), Wide Area Networks (WANs) (e.g., the Internet), wireless data networks, some other electronic data network, or some combination thereof. In various embodiments, network interface 1240 may support communication via wired or wireless general data networks, such as any suitable type of Ethernet network, for example; via telecommunications/telephony networks such as analog voice networks or digital fiber communications networks; via storage area networks such as Fibre Channel SANs, or via any other suitable type of network and/or protocol.

Input/output devices 1250 may, in some embodiments, include one or more display terminals, keyboards, keypads, touchpads, scanning devices, voice or optical recognition devices, or any other devices suitable for entering or accessing data by one or more computer systems 1200. Multiple input/output devices 1250 may be present in computer system 1200 or may be distributed on various nodes of computer system 1200. In some embodiments, similar input/output devices may be separate from computer system 1200 and may interact with one or more nodes of computer system 1200 through a wired or wireless connection, such as over network interface 1240.

As shown in FIG. 12, memory 1220 may include program instructions 1222, which may be processor-executable to implement any element or action described above. In one embodiment, the program instructions may implement the methods described above. In other embodiments, different elements and data may be included. Note that data may include any data or information described above.

Those skilled in the art will appreciate that computer system 1200 is merely illustrative and is not intended to limit the scope of embodiments. In particular, the computer system and devices may include any combination of hardware or software that can perform the indicated functions, including computers, network devices, Internet appliances, PDAs, wireless phones, pagers, etc. Computer system 1200 may also be connected to other devices that are not illustrated, or instead may operate as a stand-alone system. In addition, the functionality provided by the illustrated components may in some embodiments be combined in fewer components or distributed in additional components. Similarly, in some embodiments, the functionality of some of the illustrated components may not be provided and/or other additional functionality may be available.

Those skilled in the art will also appreciate that, while various items are illustrated as being stored in memory or on storage while being used, these items or portions of them may be transferred between memory and other storage devices for purposes of memory management and data integrity. Alternatively, in other embodiments some or all of the software components may execute in memory on another device and communicate with the illustrated computer system via inter-computer communication. Some or all of the system components or data structures may also be stored (e.g., as instructions or structured data) on a computer-accessible medium or a portable article to be read by an appropriate drive, various examples of which are described above. In some embodiments, instructions stored on a computer-accessible medium separate from computer system 1200 may be transmitted to computer system 1200 via transmission media or signals such as electrical, electromagnetic, or digital signals, conveyed via a communication medium such as a network and/or a wireless link. Various embodiments may further include receiving, sending or storing instructions and/or data implemented in accordance with the foregoing description upon a computer-accessible medium. Generally speaking, a computer-accessible medium may include a non-transitory, computer-readable storage medium or memory medium such as magnetic or optical media, e.g., disk or DVD/CD-ROM, volatile or non-volatile media such as RAM (e.g. SDRAM, DDR, RDRAM, SRAM, etc.), ROM, etc. In some embodiments, a computer-accessible medium may include transmission media or signals such as electrical, electromagnetic, or digital signals, conveyed via a communication medium such as network and/or a wireless link.

The methods described herein may be implemented in software, hardware, or a combination thereof, in different embodiments. In addition, the order of the blocks of the methods may be changed, and various elements may be added, reordered, combined, omitted, modified, etc. Various modifications and changes may be made as would be obvious to a person skilled in the art having the benefit of this disclosure. The various embodiments described herein are meant to be illustrative and not limiting. Many variations, modifications, additions, and improvements are possible. Accordingly, plural instances may be provided for components described herein as a single instance. Boundaries between various components, operations and data stores are somewhat arbitrary, and particular operations are illustrated in the context of specific illustrative configurations. Other allocations of functionality are envisioned and may fall within the scope of claims that follow. Finally, structures and functionality presented as discrete components in the example configurations may be implemented as a combined structure or component. These and other variations, modifications, additions, and improvements may fall within the scope of embodiments as defined in the claims that follow.

What is claimed is:

1. A device, comprising:

a camera oriented to capture an image of a subject;

a device display comprising at least a display screen and a backlight configured to provide a light output which at least partially passes through the display screen as part of a light output of the device display;

a memory storing a predetermined relationship between magnitude of light output provided by at least one portion of the device display, light output color of at least one portion of the of the display screen corresponding to the at least one portion of the device display, and electrical power supplied to at least one portion of the backlight; and an illumination processor configured to:

adjustably control a magnitude of light output provided by the at least one portion of the device display, wherein, to adjustably control the magnitude of light output provided by the at least one portion of the device display, the illumination processor is configured to:

determine a current light output color for the at least one portion of the device display and a target magnitude of light output; and based at least in part upon the predetermined relationship stored in the memory, the current light output color, and the target magnitude of light output, cause to adjust electrical power supplied to the at least one portion of the backlight to compensate for an effect on magnitude of the light output of the at least one portion of the display screen corresponding to the current light output color.

2. The device of claim 1, wherein:

to adjustably control the magnitude of light output provided by the at least one portion of the device display, the illumination processor is further configured to adjust a transmittance of the at least one portion of the display screen.

3. The device of claim 1, wherein:

to adjustably control the magnitude of light output provided by the at least one portion of the device display, the illumination processor is configured to adjustably control the magnitude of light output provided by at least one portion of the backlight, based at least in part upon a color displayed by at least one corresponding portion of the display screen through which the light output passes.

4. The device of claim 3, wherein:

the at least one portion of the backlight comprises a set of light-emitting diodes (LEDs); and to adjustably control the magnitude of light output provided by the at least one portion of the backlight, the illumination processor is configured to adjustably control electrical current application to at least one LED of the set, based at least in part upon an adjustment of the color displayed by the at least one corresponding portion of the display screen.

5. The device of claim 1, wherein to cause to adjust electrical power supplied to the at least one portion of the backlight, the illumination processor is configured to:

cause to adjust electrical power supplied to the at least one portion of the device display based at least in part upon monitoring illumination of at least one portion of the subject in the image.

6. The device of claim 1, wherein the illumination processor is further configured to:

cause the device display to adjustably provide illumination of one or more portions of the subject, wherein:

the illumination processor is configured to switch between causing the device display to provide illumination via a first illumination mode and causing the device display to provide illumination via a second illumination mode;

in the first illumination mode, the illumination processor is configured to:

cause the device display to provide illumination of the one or more portions of the subject from a continuous light output of a first zone of the display screen while the image of the subject is displayed on a second zone of the display screen that is different than the first zone; and in the second illumination mode, the illumination processor is configured to cause the device display to provide illumination of the subject as a pulsed light output of the device display without displaying the image of the subject on the display screen, wherein the camera is configured to capture images of the subject synchronously with emission of the pulsed light output.

7. The device of claim 6, wherein to cause the device display to adjustably provide illumination of one or more portions of the subject, the illumination processor is further configured to:

determine a signal to noise ratio (SNR) of at least a portion of the image of the subject; and determine, based at least in part on a comparison of the SNR of the at least a portion of the image of the subject to an image quality threshold, at least one of a first position on the display screen for the first zone or a second position on the display screen for the second zone.

8. A method, comprising:

performing, by one or more processors of at least one computer system:

receiving, from a camera, an image of a subject; and adjustably controlling a magnitude of light output provided by at least one portion of a device display to illuminate, via the device display, one or more portions of the subject, wherein the device display comprises a backlight and a display screen, wherein the backlight provides light output which at least partially passes through the display screen to provide the light output provided by at least one portion of a device display, and wherein the adjustably controlling the magnitude of light output comprises:

determining a current light output color for the at least one portion of the device display and a target magnitude of light output; and based at least in part upon the current light output color, the target magnitude of light output, and a predetermined relationship stored in a memory of the at least one computer system between the magnitude of light output provided by the at least one portion of the device display, light output color of at least one portion of the of the display screen corresponding to the at least one portion of the device display, and electrical power supplied to at least one portion of the backlight, causing to adjust electrical power supplied to the at least one portion of the backlight to compensate for an effect on magnitude of the light output of the at least one portion of the display screen corresponding to the current light output color.

9. The method of claim 8, wherein:

the adjustably controlling the magnitude of the light output provided by the at least one portion of the device display further comprises causing to adjust a transmittance of the at least one portion of the display screen.

10. The method of claim 8, wherein:

the adjustably controlling the magnitude of light output provided by at least one portion of the device display comprises causing to adjust, based at least in part upon the predetermined relationship between the magnitude of light output provided by the at least one portion of the device display and light output color of at least one portion of the display screen corresponding to the at least one portion of the device display, the magnitude of light output provided by at least one portion of the backlight, wherein the at least one portion of the backlight is configured to provide light output which at least partially passes through the at least one portion of the display screen as the light output of the at least one portion of the display screen.

11. The method of claim 10, wherein causing to adjust the magnitude of light output provided by the at least one portion of the backlight comprises:

causing to adjust the magnitude of light output provided by the at least one portion of the backlight based at least in part upon monitoring illumination of at least one portion of the subject by the light output of the at least one portion of the display screen.

12. The method of claim 8, wherein:

the at least one portion of the backlight comprises a set of light-emitting diodes (LEDs); and causing to adjust the magnitude of light output provided by the at least one portion of the backlight comprises adjusting electrical current application to at least one LED of the set, based at least in part upon an adjustment of a color displayed by the at least one portion of the display screen which corresponds to at least the at least one LED.

13. The method of claim 8, further comprising:

causing to illuminate, via the device display, one or more portions of the subject, wherein:

the one or more processors are configured to switch between a first illumination mode and a second illumination mode;

in the first illumination mode, the causing to illuminate comprises causing to provide a continuous light output of a first zone of the display screen while the image of the subject is displayed on a second zone of the display screen that is different than the first zone;

in the second illumination mode, the causing to illuminate comprises causing to pulse a pulsed light output of the device display without displaying the image of the subject on the display screen.

14. The method of claim 13, further comprising:

determining an image quality level of at least a portion of the image of the subject, wherein the determining the image quality level includes determining a signal to noise ratio (SNR) of the at least a portion of the image of the subject; and comparing the image quality level of the at least a portion of the image of the subject to an image quality threshold;

wherein at least one of a first position on the display screen for the first zone or a second position on the display screen for the second zone is determined based at least in part upon the comparing the image quality level to the image quality threshold.

15. A method, comprising:

configuring a device, which comprises a display which further comprises a display screen and a backlight, to adjustably control a magnitude of light output provided by at least one portion of the display, wherein the light output is produced at least in part by the backlight and at least partially passes through the display screen, and wherein the configuring comprises:

coupling an instance of processor circuitry to a power management module configured to adjustably supply electrical power to at least one portion of the backlight, such that the instance of processor circuitry is configured, based at least in part upon a current light output color, a target magnitude of light output, and a predetermined relationship stored in a memory of the device between the magnitude of light output provided by the at least one portion of the display, light output color of at least one portion of the of the display screen corresponding to the at least one portion of the display, and electrical power supplied to at least one portion of the backlight, to adjust electrical power supplied to the at least one portion of the backlight to compensate for an effect on magnitude of the light output of the at least one portion of the display screen corresponding to the current light output color.

16. The method of claim 15, wherein:

the configuring comprises coupling the instance of processor circuitry to the power management module configured to adjustably supply electrical power to at least one portion of the backlight, such that the instance of processor circuitry is configured to adjustably control the electrical power supplied to at least one portion of the backlight which corresponds to the at least one portion of the display screen, based at least in part upon the color of the light output of the at least one portion of the display screen.

17. The method of claim 16, wherein:

the at least one portion of the backlight comprises a set of light-emitting diodes (LEDs); and adjustably controlling the electrical power supplied to the at least one portion of the backlight comprises adjustably controlling electrical current application to at least one LED of the set, based at least in part upon an adjustment of the color of the light output of the at least one portion of the display screen.

18. The method of claim 15, wherein the configuring further comprises:

coupling the instance of processor circuitry to a camera device; and coupling the instance of processor circuitry to the display, such that the instance of processor circuitry is configured to:

process an image of a subject captured by the camera device to determine an illumination of one or more portions of the subject; and cause the display to provide the illumination of one or more portions of the subject, wherein:

the instance of processor circuitry is configured to switch between causing the display to provide illumination via a first illumination mode and causing the display to provide illumination via a second illumination mode;

in the first illumination mode, the instance of processor circuitry is configured to cause the display to provide illumination of the one or more portions of the subject from a continuous light output of a first zone of the display screen while the image of the subject is displayed on a second zone of the display screen that is different than the first zone; and in the second illumination mode, the instance of processor circuitry is configured to cause the display to provide illumination of the one or more portions of the subject as a pulsed light output of the display without displaying the image of the subject on the display screen.

19. The method of claim 18, wherein the processor circuitry is configured to:

determine a signal to noise ratio (SNR) of at least a portion of the image of the subject; and determine, based at least in part on a comparison of the SNR of the at least a portion of the image of the subject to an image quality threshold, at least one of a first position on the display screen for the first zone or a second position on the display screen for the second zone.

20. The method of claim 18, wherein, in the second illumination mode, the instance of processor circuitry is configured to cause the camera device to capture images of the subject synchronously with emission of the pulsed light output.

* * * * *